US008794998B2

(12) United States Patent
Hashimoto et al.

(10) Patent No.: US 8,794,998 B2
(45) Date of Patent: Aug. 5, 2014

(54) SWITCHING HUB DEVICE AND CONNECTOR LOCK RELEASING TOOL

(71) Applicant: Fujitsu Limited, Kawasaki (JP)

(72) Inventors: Koujiro Hashimoto, Yokohama (JP); Yuuki Uragou, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 25 days.

(21) Appl. No.: 13/693,242

(22) Filed: Dec. 4, 2012

(65) Prior Publication Data

US 2013/0178082 A1 Jul. 11, 2013

(30) Foreign Application Priority Data

Jan. 6, 2012 (JP) ..... 2012-001260

(51) Int. Cl.
*H01R 13/60* (2006.01)
*H01R 13/66* (2006.01)

(52) U.S. Cl.
USPC ..... 439/540.1; 439/344; 439/483

(58) Field of Classification Search
CPC ..... H01R 13/518; H01R 13/6335; H01R 23/025; H01R 13/6272
USPC ..... 439/153, 540.1, 483, 344
See application file for complete search history.

(56) References Cited

U.S. PATENT DOCUMENTS

| | | | | |
|---|---|---|---|---|
| 6,109,978 | A * | 8/2000 | Stellman et al. | 439/701 |
| 6,123,564 | A * | 9/2000 | Belmore, III | 439/344 |
| 6,547,585 | B2 * | 4/2003 | Bradley et al. | 439/353 |
| 6,796,844 | B1 * | 9/2004 | Edwards, III | 439/638 |
| 6,857,900 | B2 * | 2/2005 | Kleeberger et al. | 439/540.1 |
| 7,140,911 | B1 * | 11/2006 | Rector et al. | 439/540.1 |
| 7,374,447 | B2 * | 5/2008 | Matsumoto | 439/344 |
| 7,517,241 | B2 * | 4/2009 | Gundlach et al. | 439/352 |
| 7,901,237 | B2 * | 3/2011 | Abe et al. | 439/354 |
| 2010/0190367 | A1 | 7/2010 | Abe et al. | |

FOREIGN PATENT DOCUMENTS

JP 2010-176887 8/2010

* cited by examiner

*Primary Examiner* — Hae Moon Hyeon
(74) *Attorney, Agent, or Firm* — Staas & Halsey LLP

(57) ABSTRACT

A switching hub device includes a connector group including a plurality of connectors, the plurality of connectors each having a hole to insert a cable and including a locking unit to lock the cable inserted into the hole, a plurality of lock releasing members each to release the cable from the locking unit of each of the connectors by pressing a lock releasing unit provided in the cable, a supporting member to pivotally support each of the lock releasing members facing the lock releasing unit, and a handle having a fitting portion to fit with each of the lock releasing members supported by the supporting member, the handle gripping each of the lock releasing members fitted with the fitting portion.

6 Claims, 25 Drawing Sheets

SWITCHING HUB DEVICE AND CONNECTOR LOCK RELEASING TOOL

CROSS-REFERENCE TO RELATED APPLICATION

This application is based upon and claims the benefit of priority of the prior Japanese Patent Application No. 2012-1260, filed on Jan. 6, 2012, the entire contents of which are incorporated herein by reference.

FIELD

The embodiment discussed herein is related to a switching hub device and a connector lock releasing tool.

BACKGROUND

A switching hub device is provided with connectors to be connected with a communication cable, such as a LAN (local area network) cable and an FC (fiber channel) cable. For example, in a case of connecting an FC cable with a switching hub device, SFP (small form factor pluggable) is used as a connector for the switching hub device.

In recent years, a number of electric instruments to be connected with a switching hub device via a communication cable has been increasing. Therefore, there is a demand for high density packaging of connectors to switching hub devices. For example, in order to achieve high density packaging, an FC switching hub device has a structure of disposing a pair of connectors back to back.

In addition, upon changing an electric instrument in connection with a switching hub device, an operation of removing a communication cable from the switching hub device is desired. That is, it turns out to carry out an operation of separating a connector attached on a tip of the communication cable from the switching hub device.

An operation of mounting a communication cable to the switching hub device is to be an operation of inserting the communication cable into a connector of the switching hub device. As the communication cable is inserted into the connector, a locking member of the connector is activated to fix the communication cable in a state of being connected with the connector. In contrast, the operation of separating a communication cable from a connector is to be an operation of pulling out the communication cable from the connector while releasing the lock by pressing a lock releasing lever of the communication cable to a side of the communication cable.

Since a connector is provided with the locking member in such a manner, it is carried out to release the lock by inserting a finger to a side of the connector in order to separate the communication cable from the switching hub device.

Here, a related technique is proposed, as a technique to separate a communication cable from a switching hub device, to separate a large number of modular plugs collectively from the switching hub device by releasing the locks of a plurality of modular jacks all together.

Japanese Laid-open Patent Publication No. 2010-176887 is an example of related art.

However, a switching hub device in the past turns out to be provided with a space to insert a finger on a side of providing the lock releasing lever of the communication cable, and thus it is not easy to shorten the intervals between the connectors more than that. Therefore, in a switching hub device in the past, it is difficult to improve the packaging density of connectors. In this regard, in a case of disposing the connectors back to back, a space to insert one finger may be utilized as a space to release the locks of two connectors. However, even in the case of disposing connectors back to back, a space to insert at least one finger is desired for a width between the connectors on a side of the lock releasing lever, so that it is difficult to improve the packaging density of the connectors more than that.

In addition, the related technique to release the locks of a plurality of modular jacks all together has a structure of releasing the locks of the connectors by sandwiching a tool to release the locks all together with fingers. Therefore, even in this related technique, the side of the lock releasing lever of a connector is provided with a space to insert a finger. Accordingly, even when using this related technique, it is not easy to narrow the space between connectors on the side of the lock releasing levers, and thus it is difficult to improve the packaging density of the connectors.

SUMMARY

According to an aspect of the invention, a switching hub device includes a connector group including a plurality of connectors, the plurality of connectors each having a hole to insert a cable and including a locking unit to lock the cable inserted into the hole, a plurality of lock releasing members each to release the cable from the locking unit of each of the connectors by pressing a lock releasing unit provided in the cable, a supporting member to pivotally support each of the lock releasing members facing the lock releasing unit, and a handle having a fitting portion to fit with each of the lock releasing members supported by the supporting member, the handle gripping each of the lock releasing members fitted with the fitting portion.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENT

A detailed description is given below to a switching hub device and a connector lock releasing tool according to an embodiment based on the drawings. It is noted that the switching hub device and the connector lock releasing tool disclosed in the present application are not limited by the embodiment below.

Figure 1:
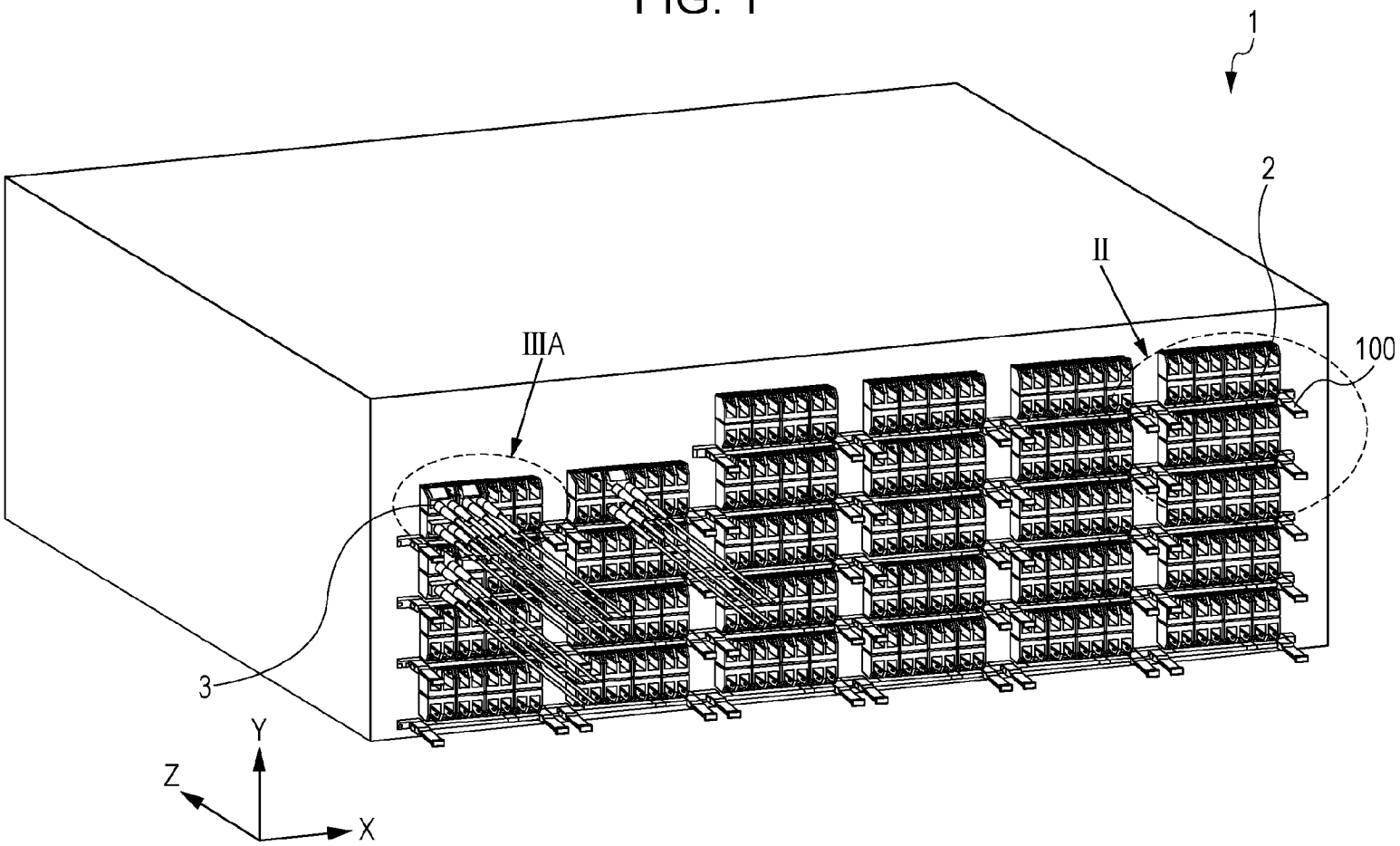
FIG. 1 is a perspective view of a switching hub device according to an embodiment.

FIG. 1 is a perspective view of a switching hub device according to an embodiment. As illustrated in FIG. 1, an FC switching hub device is described as an example for a switching hub device 1 according to the present embodiment. The switching hub device 1 is provided with a plurality of connectors 2. In the present embodiment, the connectors 2 are SFP. Then, an FC cable 3, which is a communication cable, is inserted into each connector 2. Further, lock releasing tools 100 are attached so as to correspond to the connectors 2.

Here, in a description below, an X direction, which is a width direction of the switching hub device 1, is referred to as a transverse direction. Then, a direction of an arrow in the X direction in FIG. 1 is referred to as a right direction, and a direction opposite to the arrow is referred to as a left direction. In addition, a Y direction, which is a height direction of the switching hub device 1, is referred to as a vertical direction. Then, a direction of an arrow in the Y direction in FIG. 1 is referred to as an upward direction, and a direction opposite to the arrow is referred to as a downward direction. Further, a Z direction, which is a depth direction of the switching hub device 1, is referred to as a front/rear direction. Then, a direction of an arrow in the Z direction in FIG. 1 is referred to as a backward direction, and a direction opposite to the arrow is referred to as a forward direction.

Figure 2:
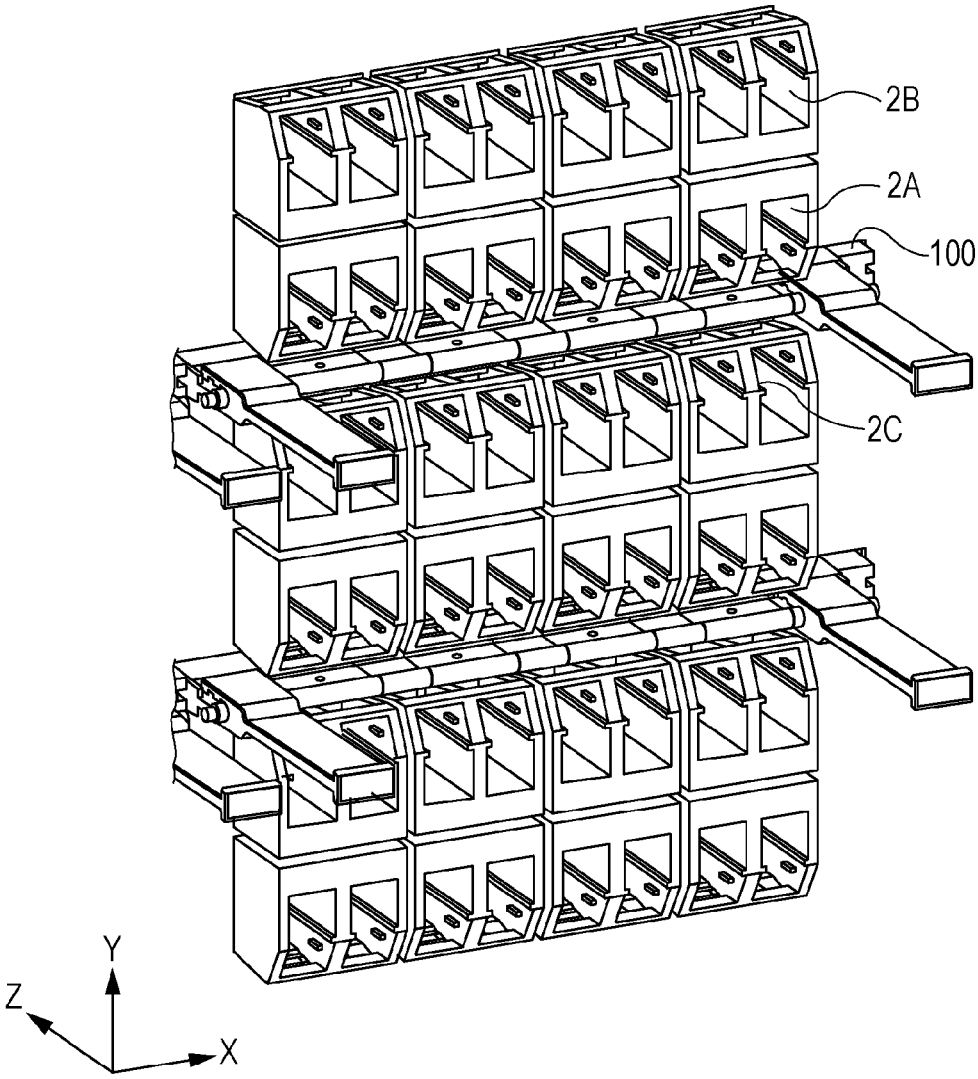
FIG. 2 is an enlarged view of a region II in FIG. 1.

FIG. 2 is an enlarged view of a region II in FIG. 1. Connectors 2A through 2C in FIG. 2 are same as the connectors 2 in FIG. 1. As illustrated in FIG. 2, the connectors 2 according to the present embodiment are connectors having two holes aligned in the transverse direction as one group. As the connectors 2, the one pair of connectors 2A and 2B are disposed back to back and upside down in the vertical direction. In the pair of connectors 2A and 2B, a locking member of the connector 2A is provided in a lower side, and a locking member of the connector 2B is provided in an upper side. In addition, the connectors 2B and 2C are disposed in a same manner. Still in addition, in the connectors 2 in the present embodiment, four connectors are aligned in a row in the transverse direction as a group. Then, between the four connectors 2 including the connector 2A aligned transversely as a group and the four connectors 2 including the connector 2C aligned transversely as a group, one of the lock releasing tools 100 is provided. Here, since there is a sufficient space on a side of the locking members of the outer connectors 2, the lock releasing tools 100 are not provided for them. For example, since the connector 2B has a sufficient open space on the upper side, no lock releasing tool 100 to release the lock of the connector 2B is provided on the connector 2B.

Figure 3A:
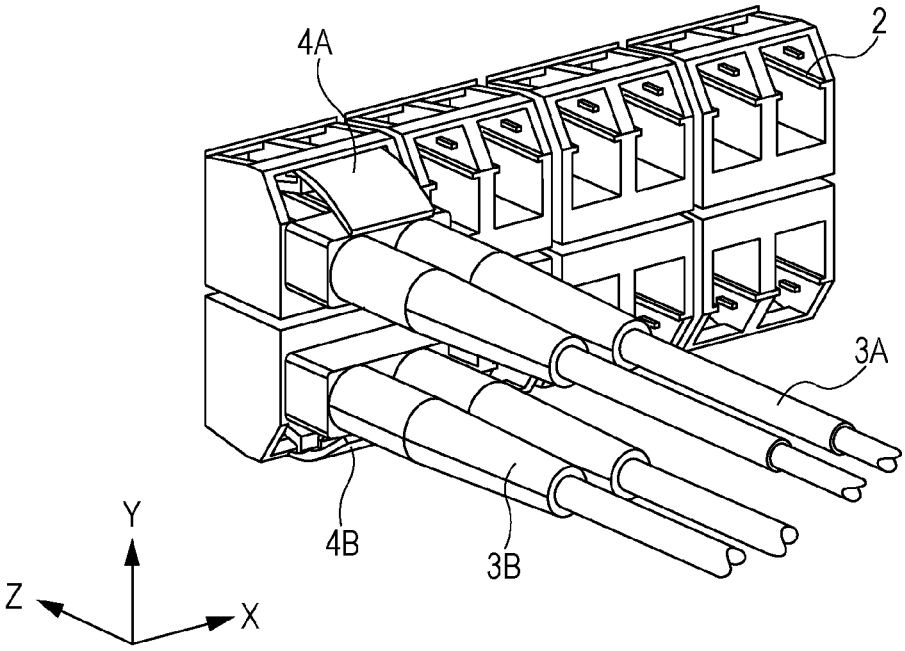
FIG. 3A is an enlarged view of a region IIIA in FIG. 1.
Figure 3B:
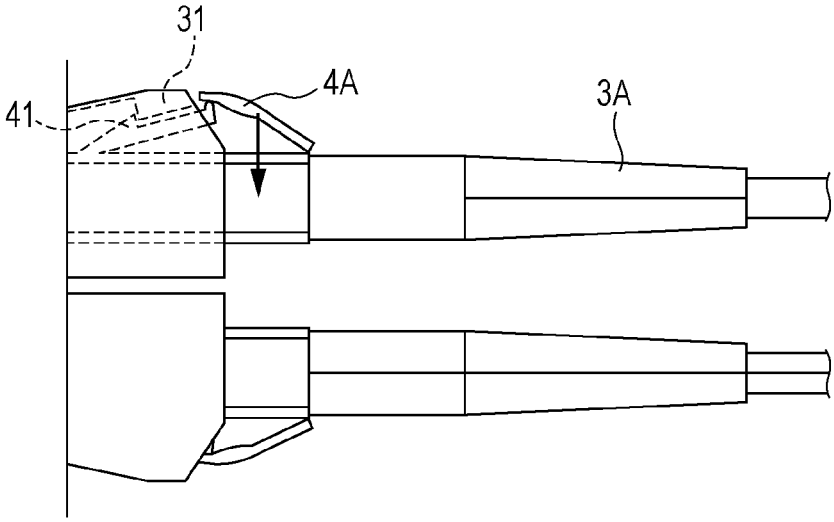
FIG. 3B is a diagram illustrating a state of fitting a connector claw with a locking claw.

FIG. 3A is an enlarged view of a region IIIA in FIG. 1. FIG. 3B is a diagram illustrating a state of fitting a connector claw with a locking claw. In FIG. 3A, for the convenience of illustration, only a portion of a block of four aligned pairs of upper and lower connectors 2 is extracted and illustrated. Specifically, FIG. 3A represents a state of FC cables 3A and 3B being inserted into the connectors 2. The FC cable 3A is inserted into the upper side of the pair of connectors and has a lock releasing lever 4A directed to the upper side. In addition, the FC cable 3B has a lock releasing lever 4B directed to the lower side. When being inserted into the connector 2, the FC cable 3A is fixed as illustrated in FIG. 3B by fitting a connector claw 31 provided on a tip of the lock releasing lever 4A with a locking claw 41, which is a locking unit, provided in the connector 2. Further, by pressing the lock releasing lever 4A to a side of the cable as depicted by the arrow, the locking claw 41 is lowered and thus the fitting of the locking claw 41 with the connector claw 31 is disconnected to release the lock of the FC cable 3A. By releasing the lock, the FC cable 3A becomes in a state of allowing pulling out from the connector 2. This is similar for the FC cable 3B as well other than being flipped upside down. This lock releasing lever 4A is equivalent to an example of "a lock releasing unit". In addition, the connector claw 31 is equivalent to an example of "a locking unit".

Figure 4:
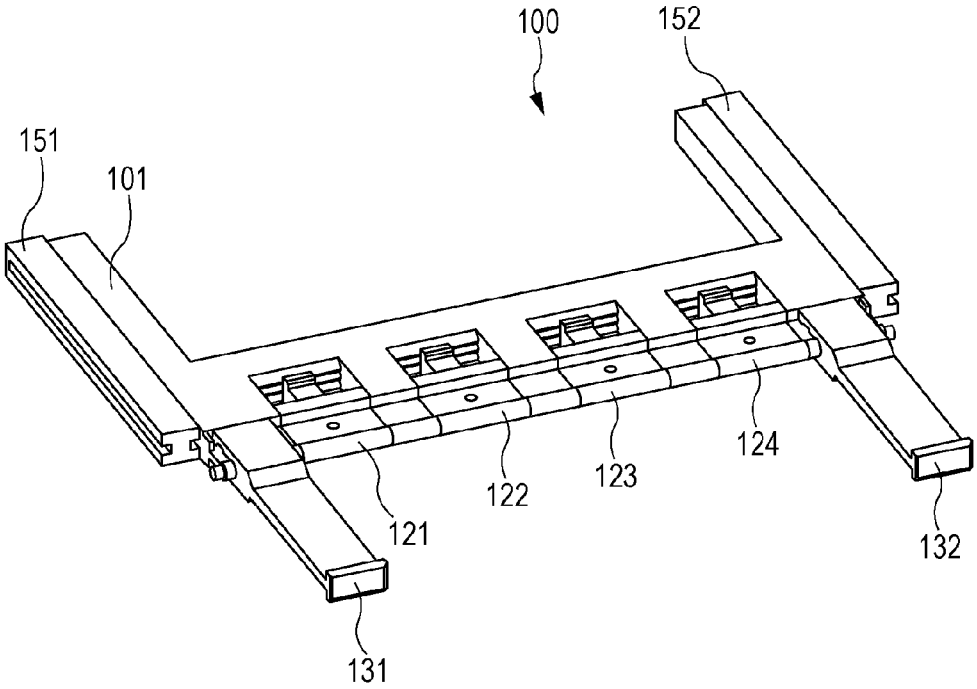
FIG. 4 is a perspective view of a lock releasing tool.
Figure 5:
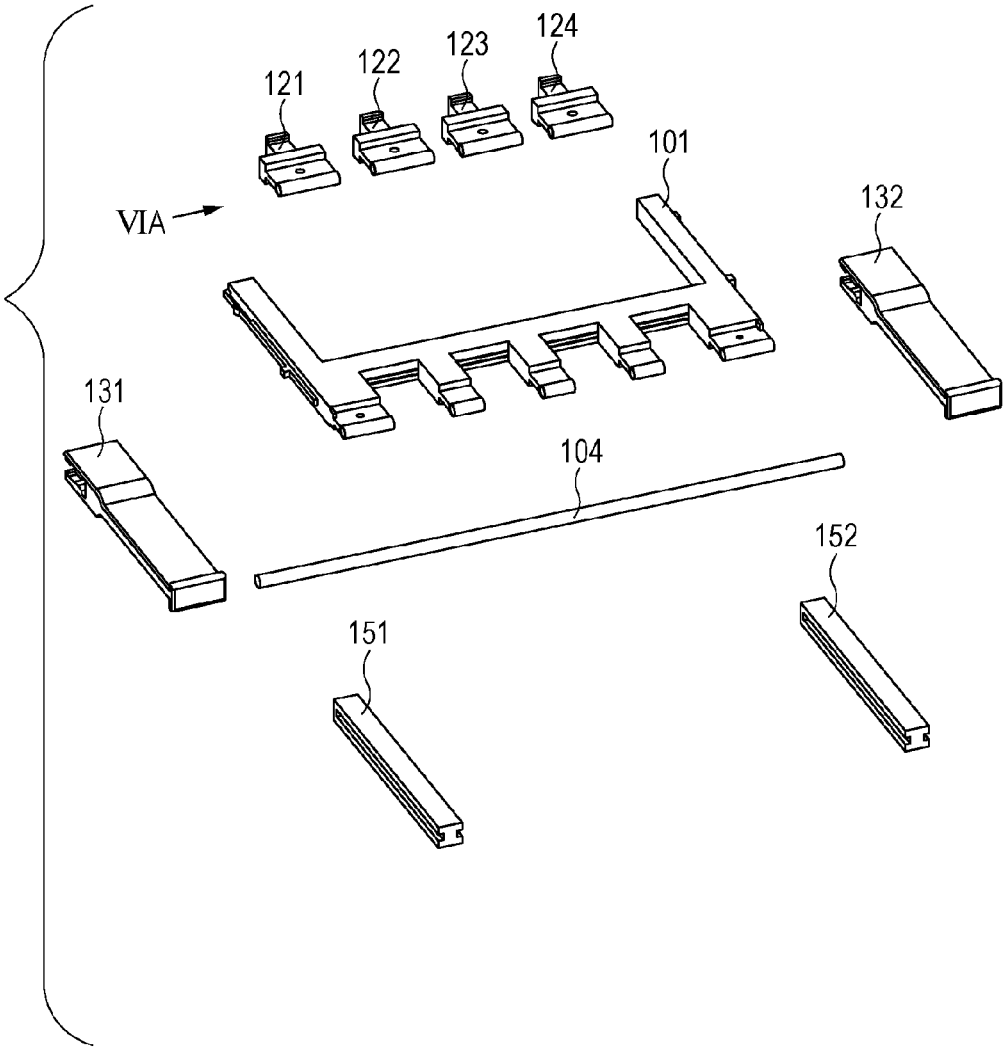
FIG. 5 is an exploded perspective view of the lock releasing tool.

FIG. 4 is a perspective view of a lock releasing tool. FIG. 5 is an exploded perspective view of the lock releasing tool.

As illustrated in FIGS. 4 and 5, the lock releasing tool 100 according to the present embodiment is configured with a sliding base 101, unlocking levers 121 through 124, handles 131 and 132, a shaft 104, and rails 151 and 152. The lock releasing tool 100 is attached to the switching hub device 1 as illustrated in FIG. 2 in such a manner that a plane formed by the sliding base 101 and the rails 151 and 152 coincides with the XZ plane and also alignment of the unlocking levers 121 through 124 coincides with the direction of aligning the connectors.

Figure 6A:
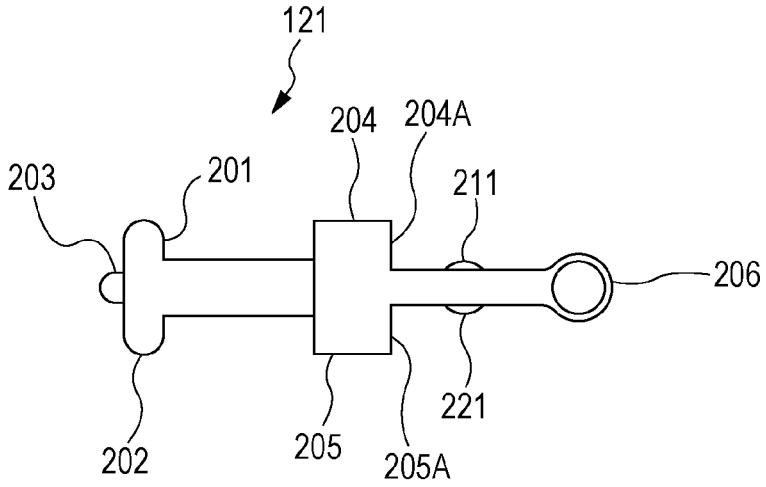
FIG. 6A is a side view of an unlocking lever.

FIG. 6A is a side view of an unlocking lever. FIG. 6A illustrates the unlocking lever 121 as an example, and is a side view taken from a direction of an arrow VIA in FIG. 5. FIG.

6B is a top view of the unlocking lever. The unlocking lever 121 has projecting portions 201 and 202 that project in upward and downward directions relative to the sheet surface of FIG. 6A. The projecting portions 201 and 202 are provided in the unlocking lever 121 at an upper end relative to the sheet surface of FIG. 6B, that is, near a tip end of the unlocking lever 121. The projecting portions 201 and 202 are areas to press the lock releasing lever of the FC cable. In addition, the unlocking lever 121 has a convex portion 203 at a left end relative to the sheet surface. In addition, the unlocking lever 121 has a cylindrical area 206 at an end opposite to the end provided with the projecting portions 201 and 202. The cylindrical area 206 is an area to be penetrated by the shaft 104. Then, the unlocking lever 121 has projections 204 and 205 spreading out in the directions extending the projecting portions 201 and 202 between the projecting portions 201 and 202 and the cylindrical area 206. The projections 204 and 205 are provided in such a manner that sides 204A and 205A, which are sides on the cylindrical area 206, coincide with sides of a groove of the sliding base 101 in a state of being fixed to the sliding base 101 as described later. Further, between the projection 204 and the cylindrical area 206, a convex portion 211 is provided. In addition, between the projection 205 and the cylindrical area 206, a convex portion 221 is provided. Although the description has been given to the unlocking lever 121 as an example here, the unlocking levers 122 through 124 also have a similar structure. Here, the convex portions 211 through 214 are equivalent to an example of "a positioning portion".

Figure 6B:
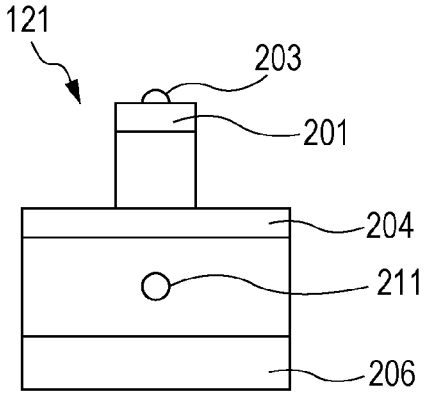
FIG. 6B is a top view of the unlocking lever.

Here, in the present embodiment, the unlocking lever 121 has, when viewed from above, a rectangular shape with a protruding side in connection with a small rectangle as illustrated in FIG. 6B. However, this is for the reasons, such as to avoid a risk of touching another lock releasing lever in alignment in a case of pressing down a lock releasing lever corresponding to the projecting portions 201 and 202. It is noted that, since there is a low risk of pressing down another lock releasing lever as long as the position of the unlocking lever 121 relative to the lock releasing lever is accurate, the unlocking lever 121 may also be in a shape of one rectangle when viewed from above. Further, in the present embodiment, the projections 204 and 205 are provided for the reasons as described later, such as to secure sliding of the handles 131 and 132 and to secure rotation of the unlocking lever 121 by the handles 131 and 132. However, when not seeking certainty of sliding of the handles 131 and 132 and rotation of the unlocking lever 121, it is also considered not to provide the projections 204 and 205. In that case, the unlocking lever 121 may also be a flat plate member simply with tip end portions in a shape of protruding in both directions orthogonal to the plate surface. The unlocking levers 121 through 124 are equivalent to an example of "a lock releasing member".

Figure 7:
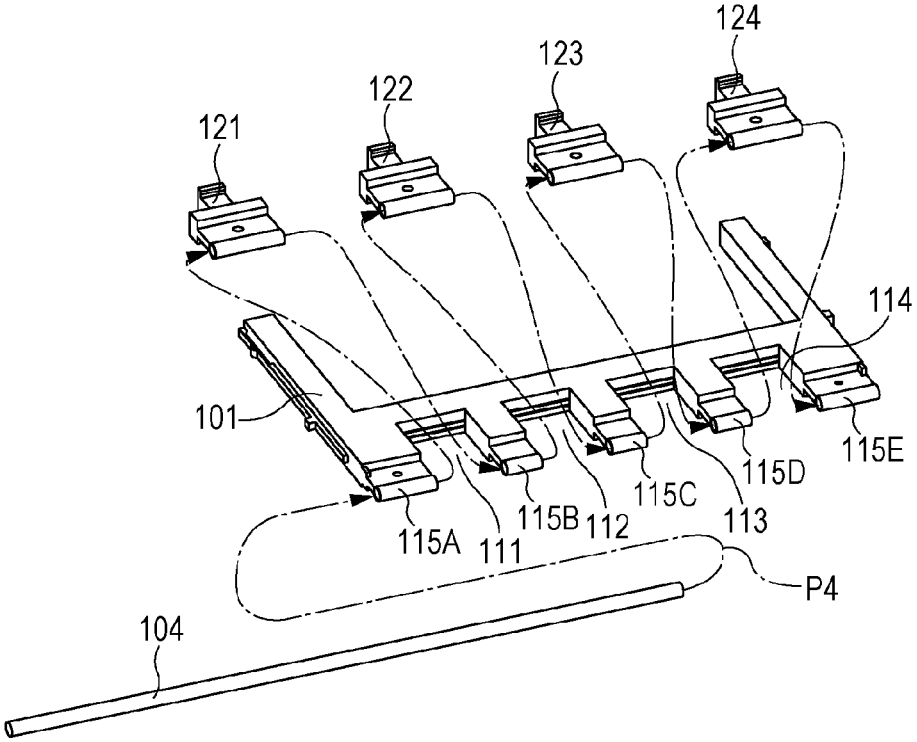
FIG. 7 is a diagram illustrating attachment of the unlocking levers to a sliding base.
Figure 8:
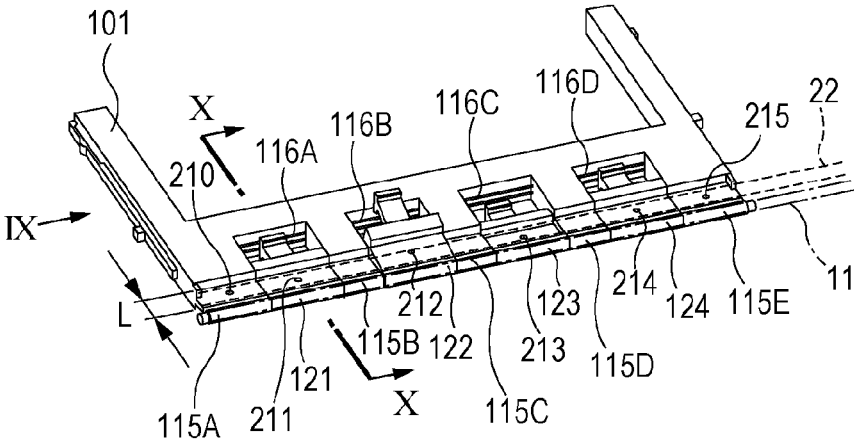
FIG. 8 is a perspective view of a state of attaching the unlocking levers to the sliding base.

FIG. 7 is a diagram illustrating attachment of the unlocking levers to a sliding base. FIG. 8 is a perspective view of a state of attaching the unlocking levers to the sliding base. FIG. 8 represents a state of the unlocking lever 122 rotating about the shaft 104 in a front direction of the sheet surface and represents a state of the unlocking lever 123 rotating about the shaft 104 in a backward direction of the sheet surface.

A dash dotted line P4 in FIG. 7 illustrates the members to be run through by the shaft 104. The unlocking levers 121 through 124 are fitted respectively into recesses 111 through 114 of the sliding base 101. The sliding base 101 has cylindrical areas 115A through 115E at positions continued to the cylindrical areas 206 (refer to FIG. 6A) of the unlocking levers 121 through 124 in a state of fitted with the unlocking levers 121 through 124. Then, in the state of fitting the unlocking levers 121 through 124 into the recesses 111 through 114 of the sliding base 101, the shaft 104 penetrates through the cylindrical areas 115A through 115E of the sliding base 101 and the cylindrical areas 206 of the unlocking levers 121 through 124 in order as depicted by the dash dotted line P4. This causes the unlocking levers 121 through 124 are supported by the shaft 104 rotatably relative to the sliding base 101. In such a manner, as in FIG. 8, the unlocking levers 121 through 124 are attached to the sliding base 101 in a state of being supported by the shaft 104 rotatably.

In addition, the sliding base 101 has grooves 116A through 116D so as to correspond to the unlocking levers 121 through 124 as in FIG. 8. The grooves 116A through 116D are described in detail later.

In addition, the cylindrical areas 115A through 115E and the cylindrical areas 206 of the unlocking levers 121 through 124 have a same diameter. Then, the cylindrical areas 115A through 115E and the cylindrical areas 206 of the unlocking levers 121 through 124 become a series of cylinder that has a part spreading out in a plate form as illustrated in FIG. 8 by being penetrated and aligned in a row by the shaft 104. Hereinafter, the series of cylinder formed by the cylindrical areas 115A through 115E and the cylindrical areas 206 of the unlocking levers 121 through 124 is referred to as "a sliding cylinder 11". In FIG. 8, to facilitate understanding, the sliding cylinder 11 is depicted by a dash dotted line.

Further, a plate member spreading out of a part of the cylindrical areas 115A through 115E of the sliding base 101 is made one-step higher at positions same as the projections 204 and 205 in a state of the unlocking levers 121 through 124 being positioned in the plane same as the sliding base 101. Here, to be positioned in the same plane means, as described later, a state of suppressing the rotation of the unlocking levers 121 through 124 by the sliding base 101 in a case of not carrying out the lock releasing behavior. This causes, in a state of the unlocking levers 121 through 124 being positioned in the plane same as the sliding base 101, a groove 22 having a width L in FIG. 8 spreads in parallel with the sliding cylinder 11. Hereinafter, this groove 22 is referred to as "a sliding groove 22". In FIG. 8, to facilitate understanding, the sliding groove 22 is depicted by a broken line. Although only one side of the sliding groove 22 is visible in FIG. 8, the opposite plane is also provided with a sliding groove. Here, while both planes of the unlocking levers 121 through 124 and the sliding base 101 are provided with the sliding grooves in the present embodiment, it is also possible to provide the sliding groove only in one side.

In the sliding groove 22, the convex portions 211 and 221 provided in the unlocking levers 121 through 124 are positioned in the middle of respective shorter directions of the unlocking levers 121 through 124. Further, the sliding base 101 is provided with convex portions 210 and 215 in a portion of the sliding groove 22 so as to be aligned with the convex portions 211 through 214 of the unlocking levers 121 through 124. While only the convex portions 210 and 215 in the sliding groove 22 on one side are depicted in FIG. 8, convex portions similar to the sliding base 101 are also provided in the sliding groove 22 on the opposite side in practice. This sliding base 101, the shaft 104, and the rails 151 and 152 are equivalent to an example of "a supporting member".

Figure 9:
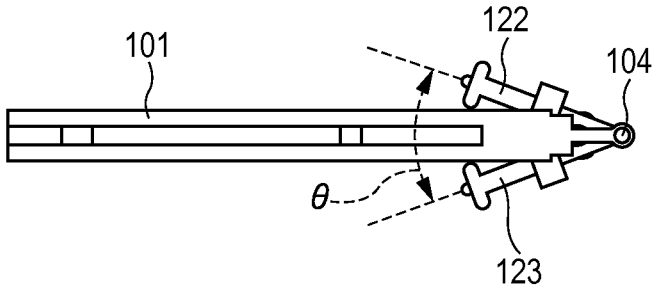
FIG. 9 is a diagram for illustration of rotation of the unlocking levers.

FIG. 9 is a diagram for illustration of rotation of the unlocking levers. FIG. 9 represents a state of rotation in a state of attaching the unlocking lever 121 to the sliding base 101 taken from a direction of an arrow IX in FIG. 8.

The unlocking lever 122 in FIG. 9 is in a state of being rotated about the shaft 104 in one direction relative to the sliding base 101. In addition, the unlocking lever 123 is in a state of being rotated about the shaft 104 in a direction opposite to the unlocking lever 122 relative to the sliding base 101. That is, the unlocking levers 121 through 124 move symmetrically an angle 0 relative to the sliding base 101. That is, the unlocking levers 121 through 124 move symmetrically in the upward and downward directions at the angle 0 relative to the sliding base 101 in a case of attaching the lock releasing tool 100 to the switching hub device 1 as in FIG. 1.

Figure 10:
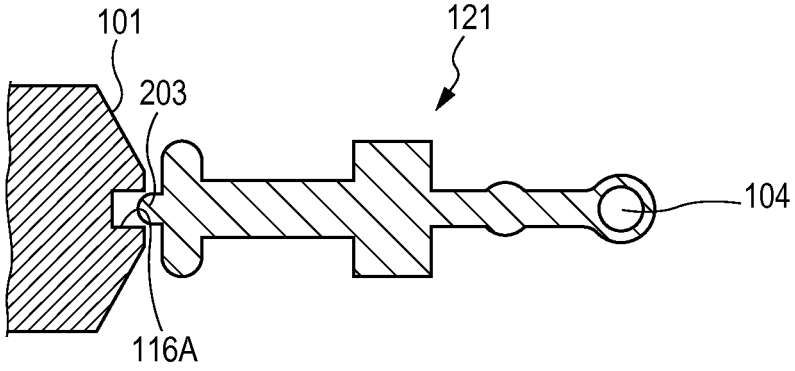
FIG. 10 is a cross-sectional view taken from X-X in FIG. 8.

FIG. 10 is a cross-sectional view taken from X-X in FIG. 8. As illustrated in FIG. 10, the sliding base 101 has the groove 116A in a portion making contact with the convex portion 203 of the unlocking lever 121.

The convex portion 203 of the unlocking lever 121 fits in the groove 116A of the sliding base 101 to suppress the rotation of the unlocking lever 121 about the shaft 104. That is, the unlocking lever 121 is maintained without falling in the downward direction by fitting the convex portion 203 in the groove 116A in a state of attaching the lock releasing tool 100 to the switching hub device 1 as in FIG. 1. The state of the convex portion 203 being fit in the groove 116A is the state of the unlocking lever 121 being positioned in the plane formed by the sliding base 101, described above. Then, as a force more than a certain value is applied to the unlocking lever 121 in a direction of rotation about the shaft 104, the convex portion 203 is disconnected from the groove 116A to carry out rotational movement.

Figure 11A:
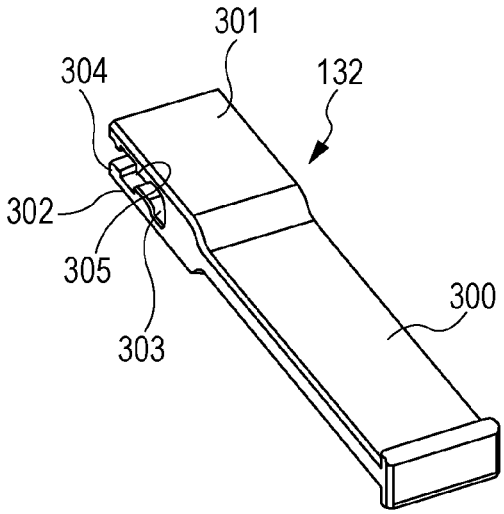
FIG. 11A is a forward perspective view of a handle.
Figure 11B:
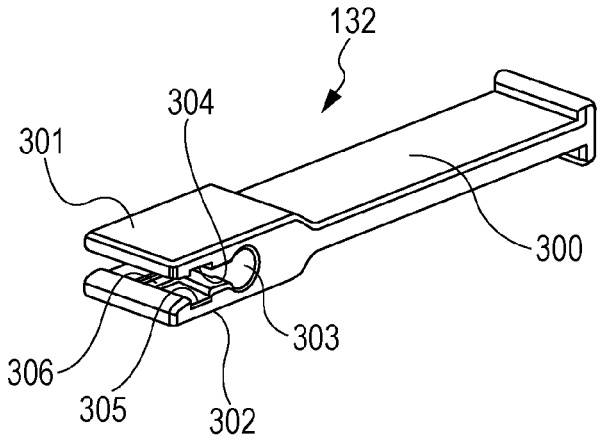
FIG. 11B is a rearward perspective view of the handle.

FIG. 11A is a forward perspective view of a handle. FIG. 11B is a rearward perspective view of the handle. Here, a side of the sliding base 101 of the handle 132 is defined as rearward, and a side opposite to the sliding base 101 of the handle 132 is defined as forward.

As illustrated in FIGS. 11A and 11B, the handle 132 is split from a grip portion 300 in a flat plate shape into two of sandwiching portions 301 and 302 both in a flat plate shape. The sandwiching portions 301 and 302 are equivalent to an example of "a fitting portion". The sandwiching portions 301 and 302 are facing each other and have a slit. A side of the grip portion 300 of the slit, that is, a portion of connecting the sandwiching portions 301 and 302 is made to be a groove 303 spreading in a shorter direction having a cross-section in a shape of "C". In addition, the sandwiching portion 301 has a groove 304 spreading in a shorter direction in a plane facing the sandwiching portion 302 on a side closer to an opening than the groove 303. In addition, the sandwiching portion 302 has a groove 305 in a plane facing the sandwiching portion 301 on a side closer to the opening than the groove 303. Then, the grooves 304 and 305 are disposed at positions facing each other. The groove 305 has a concave portion 306 at the center of the shorter direction. In addition, although not illustrated, the groove 304 also has a concave portion at a position facing the concave portion 306. The concave portion 306 and the concave portion positioned to face the concave portion 306 are equivalent to an example of "an engaging portion". Then, the groove 305 has an inclination approaching the sandwiching portion 301 from respective end portions in the shorter direction towards the opening of the concave portion 306. The groove 304 similarly has an inclination approaching the sandwiching portion 302 from respective end portions in the shorter direction towards the concave portion. That is, the cross-section of the sandwiching portion 301 in the groove 304 has a shape of a trapezoid with an upper side of a line joining the opening of the groove 304 and a lower side of the opposite plane and also the upper side being in a concave shape. This is similar for the sandwiching portion 302. This shape is described later using a drawing. While the description has been given to the handle 132 as an example in FIGS. 11A and 11B, the handle 131 has a similar shape. The handles 131 and 132 are equivalent to an example of "a handle".

Figure 12:
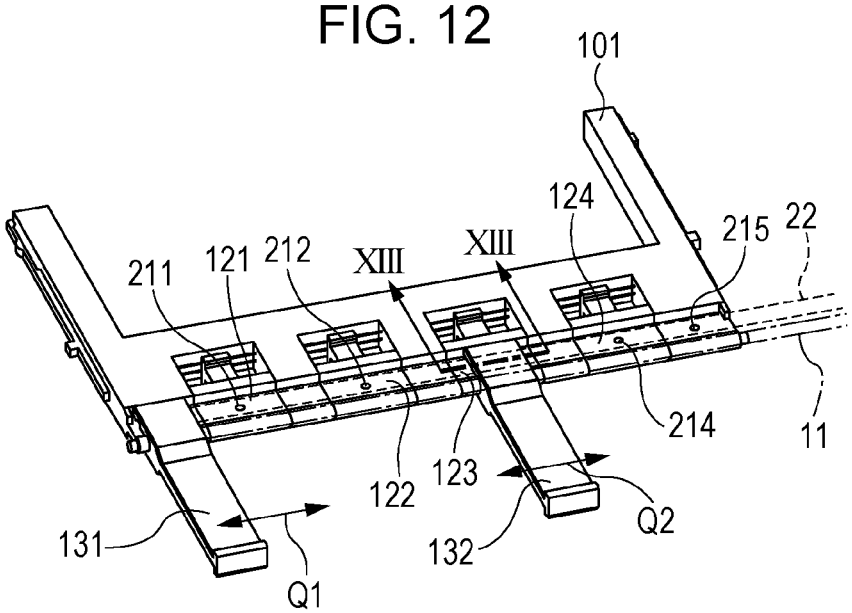
FIG. 12 is a perspective view of a state of attaching the handles to the sliding base.

FIG. 12 is a perspective view of a state of attaching the handles to the sliding base. The handle 131 sandwiches the sliding cylinder 11 and the sliding groove 22 formed by the sliding base 101 and the unlocking levers 121 through 124 therein with the sandwiching portions 301 and 302. Specifically, the handle 131 sandwiches the sliding cylinder 11 therein with the groove 303. In addition, the handle 131 sandwiches the sliding groove 22 therein with portion from the opening of the groove 303 to the end portions of the sandwiching portions 301 and 302. At this time, the grooves 304 and 305 are positioned in a portion contacting with the convex portions 210 through 215 on the sliding groove 22 when the handle 131 slides on the sliding groove 22. Then, the handles 131 and 132 slide along the sliding cylinder 11 and the sliding groove 22 as arrows Q1 and Q2. An operator to rotate the unlocking lever slides the handles 131 and 132 to the position of the unlocking lever that rotates the unlocking levers 121 through 124. For example, in a case of intending the unlocking lever 123 to rotate, an operator slides the handle 132 to the position of the unlocking lever 123 as in FIG. 12.

Figure 13:
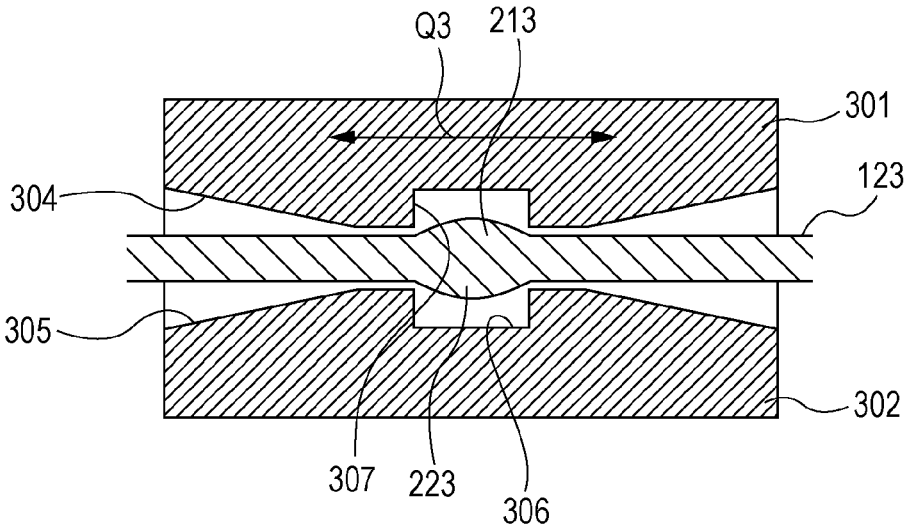
FIG. 13 is a cross-sectional view taken from XIII-XIII in FIG. 12.

FIG. 13 is a cross-sectional view taken from XIII-XIII in FIG. 12. In a case that the handle 132 is at a position of the unlocking lever 123 as in FIG. 12, as illustrated in FIG. 13, the convex portion 213 of the unlocking lever 123 is fitted with a concave portion 307 provided in the sandwiching portion 301 of the handle 132. In addition, the convex portion 223 on a side opposite to the convex portion 213 is fitted with the concave portion 306 provided in the sandwiching portion 302 of the handle 132. In such a manner, the concave portions 306 and 307 of the handle 132 is fitted with the convex portions 213 and 223 of the unlocking lever 123, thereby suppressing movement of the handle 132 in a direction of an arrow Q3, and thus it turns out to be positioned in a location preferred to rotate the unlocking lever 123.

Here, a behavior is described in a case of moving the handle 132 to the position depicted in FIG. 13. As the handle 132 slides towards a position to select the unlocking lever 123, the convex portion 213 of the unlocking lever 123 enters into the groove 304 of the sandwiching portion 301 of the handle 132. Similarly, the convex portion 223 enters into the groove 305 of the sandwiching portion 302. Then, as the handle 132 slides further, the convex portion 213 goes up the slope of the groove 304 towards a side of the sandwiching portion 302. Similarly, the convex portion 223 goes up the slope of groove 305 towards a side of the sandwiching portion 301. This causes the intervals between the sandwiching portions 301 and 302 are widened by the convex portions 213 and 223. Then, as the handle 132 moves to a position where the convex portion 213 is positioned in the concave portion 307 of the sandwiching portion 301 and the convex portion 223 is positioned in the concave portion 306 of the sandwiching portion 302, the convex portion 213 is fitted with the concave portion 307 and the convex portion 223 is fitted with the concave portion 306.

Next, a behavior is described in a case of moving the handle 132 from the position in FIG. 13. As a force of more than a certain value is applied to the handle 132 in either of the directions of the arrow Q3 in the state of FIG. 13, the intervals between the sandwiching portions 301 and 302 are widened, and thus the convex portions 213 and 223 are disconnected respectively from the concave portions 306 and 307. Then, the convex portion 213 goes down the slope of the groove 304 towards the sandwiching portion 301. In addition, the convex portion 223 goes down the slope of the groove 305 towards the sandwiching portion 302. This causes the intervals between the sandwiching portions 301 and 302 to be narrowed gradually. Then, as the convex portions 213 and 223 are disconnected from the grooves 304 and 305, the sandwiching portions 301 and 302 become in a state of sandwiching the sliding groove 22 without the convex portions 213 and 223.

Figure 14A:
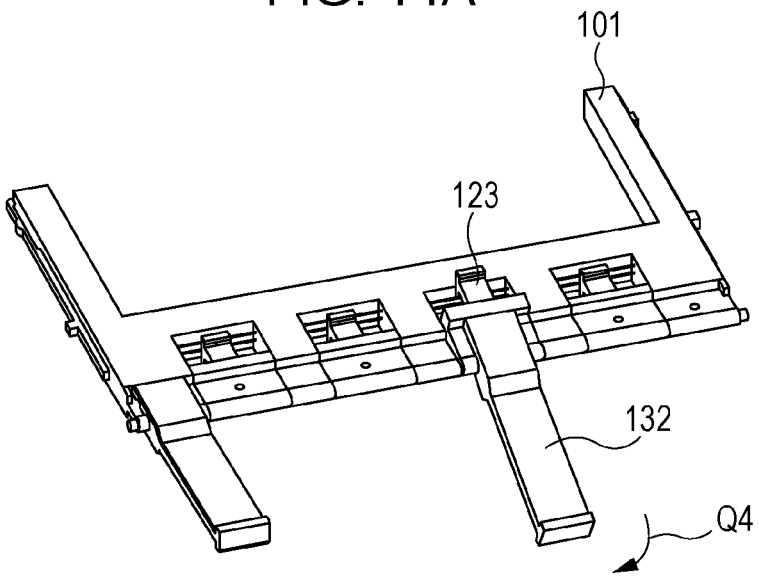
FIG. 14A is a perspective view of a state of revolving the handle.
Figure 14B:
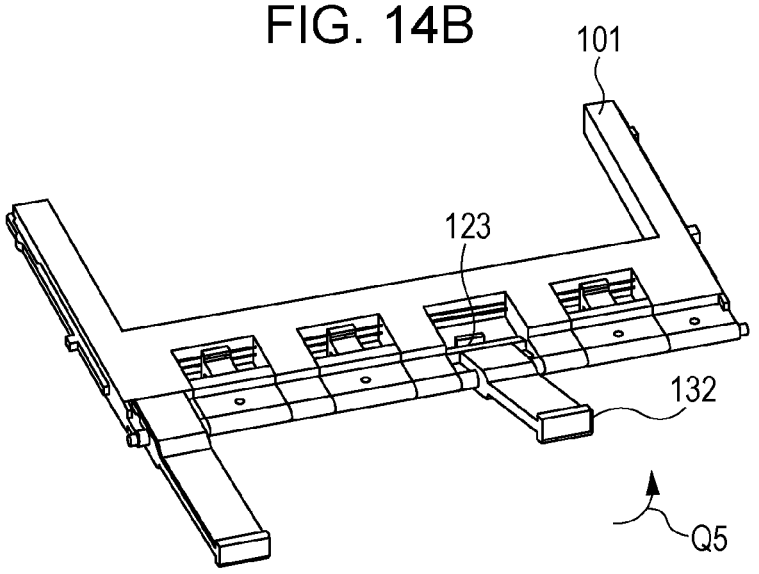
FIG. 14B is a perspective view of a state of revolving the handle in a direction opposite to FIG. 14A.

With reference to FIGS. 14A and 14B, rotation of the unlocking lever by the handle is described. FIG. 14A is a perspective view of a state of revolving the handle. FIG. 14B is a perspective view of a state of revolving the handle in a direction opposite to FIG. 14A.

In FIG. 14A, the handle 132 is moved to a position to select the unlocking lever 123, and further revolved in a direction of an arrow Q4. This causes the unlocking lever 123 is disconnected from the sliding base 101, and thus rotates about the shaft 104 in a direction same as the arrow Q4. For example, in a case of attaching the lock releasing tool 100 to the switching hub device 1 as in FIG. 1 in a state of FIG. 14A, an operator revolves the handle 132 in the direction of the arrow Q4, that is, presses down, thereby enabling to press up the unlocking lever 123.

In FIG. 14B, the handle 132 is moved to a position to select the unlocking lever 123, and further is revolved in a direction of an arrow Q5 (direction opposite to the arrow Q4). This causes the unlocking lever 123 is disconnected from the sliding base 101, and thus rotates about the shaft 104 in a direction same as the arrow Q5. For example, in a case of attaching the lock releasing tool 100 to the switching hub device 1 as in FIG. 1 in a state of FIG. 14B, an operator revolves the handle 132 in the direction of the arrow Q5, that is, presses up, thereby enabling to press down the unlocking lever 123.

Figure 15:
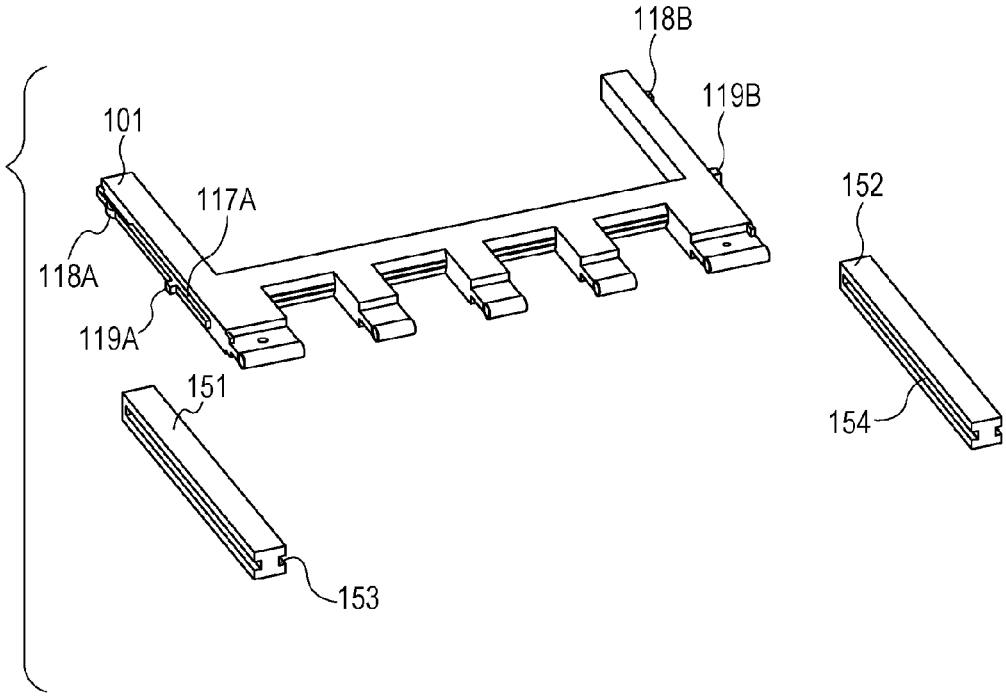
FIG. 15 is an exploded perspective view of the sliding base and rails.

Next, sliding of the sliding base 101 is described. FIG. 15 is an exploded perspective view of the sliding base and rails.

As illustrated in FIG. 15, the sliding base 101 has a guide rail 117A on a plane facing the rail 151. The guide rail 117A is disposed to spread out in the front/rear direction in FIG. 1 in a case of attaching the lock releasing tool 100 to the switching hub device 1. In addition, although not illustrated in FIG. 15, the sliding base 101 is provided with a guide rail 117B similar to the guide rail 117A on a plane facing the rail 152. Further, on the guide rail 117A, the sliding base 101 has convex portions 118A and 119A. In addition, on the guide rail 117B, the sliding base 101 has convex portions 118B and 119B. The convex portions 118A and 119A are disposed so as to be aligned in the front/rear direction in FIG. 1 in a case of attaching the lock releasing tool 100 to the switching hub device 1. Similarly, the convex portions 118B and 119B are disposed so as to be aligned in the front/rear direction in FIG. 1 in a case of attaching the lock releasing tool 100 to the switching hub device 1. Further, the rail 151 has a groove 153 spreading out in a direction of spreading the guide rail 117A of the sliding base 101 on a plane facing the sliding base 101, that is, in the front/rear direction in a case of being attached to the switching hub device 1. In addition, the rail 152 has a groove 154 spreading out in a direction of spreading the guide rail 117B of the sliding base 101 on a plane facing the sliding base 101, that is, in the front/rear direction in a case of being attached to the switching hub device 1. Then, the rail 151 is combined with the sliding base 101 so as to fit the groove 153 with the guide rail 117A and the convex portions 118A and 119A of the sliding base 101. Then, the rail 152 is combined with the sliding base 101 so as to fit the groove 154 with the guide rail 117B and the convex portions 118B and 119B of the sliding base 101.

Figure 16:
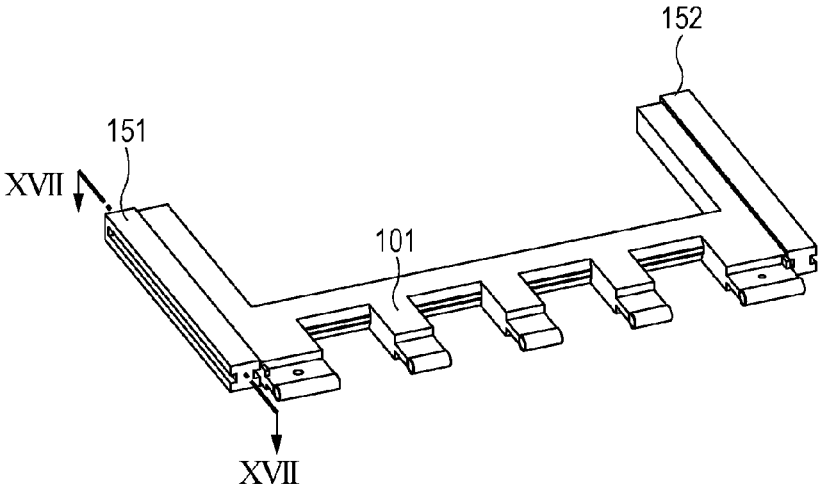
FIG. 16 is a perspective view of a state of the sliding base being positioned at a limit of movement in a backward direction.
Figure 17:
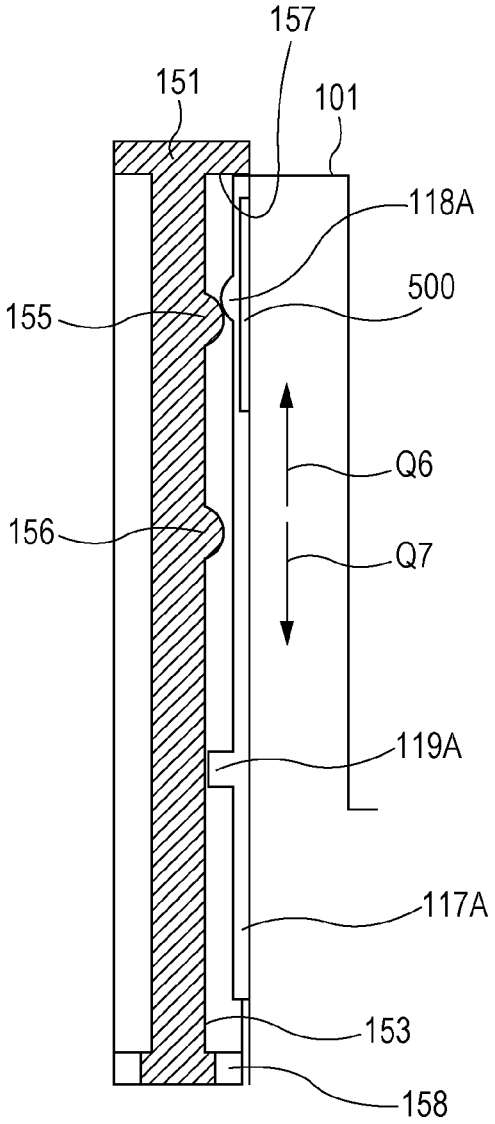
FIG. 17 is a cross-sectional view taken from XVII-XVII in FIG. 16.

FIG. 16 is a perspective view of a state of the sliding base being positioned at a limit of movement in a backward direction. FIG. 17 is a cross-sectional view taken from XVII-XVII in FIG. 16. FIG. 17 illustrates, for the convenience of illustration, only a portion of fitting the sliding base 101 with the rail 151 in the XVII-XVII cross-section.

FIG. 16 represents a state of sliding the sliding base 101 along the rails 151 and 152 to the limit of movement in the backward direction in FIG. 1 in a state of attaching the lock releasing tool 100 to the switching hub device 1.

As illustrated in FIG. 17, the groove 153 of the rail 151 terminates before reaching the end portion in a direction of an arrow Q6 (hereinafter, simply referred to as "a Q6 direction"). Here, the Q6 direction is the backward direction in FIG. 1 in a case of attaching the lock releasing tool 100 to the switching hub device 1. The groove 153 has a wall 157 in the Q6 direction. Therefore, as the sliding base 101 moves in the Q6 direction, the guide rail 117A contacts the wall 157 to be stopped as illustrated in FIG. 17. This causes the sliding base 101 to be suppressed in the movement more than that in the Q6 direction, and thus it becomes the limit of movement in the Q6 direction in FIG. 1 in a case of attaching the lock releasing tool 100 to the switching hub device 1. The groove 153 of the rail 151 is provided with convex portions 155 and 156. The convex portion 155 is disposed at a position touching the convex portion 118A in a state of positioning the sliding base 101 at the limit of movement in the backward direction. That is, in a state of positioning the sliding base 101 at the limit of movement in the Q6 direction, the movement of the sliding base 101 in the Q6 direction is suppressed by the wall 157, and the movement of the sliding base 101 in a direction opposite to Q6 is suppressed by the convex portion 155. This enables the sliding base 101 to maintain the state of being stopped at the position of the limit of movement in the Q6 direction.

Further, the guide rail 117A has a bore 500 in the rear of the convex portion 118A. The bore 500 spreads out to positions going over the respective end portions on both sides of the convex portion 118A. This enables a frame of the bore 500 on a side including the convex portion 118A to bend and the convex portion 118A to be dented in a direction apart from the rail 151. That is, as an operator pulls the sliding base 101 with a force of more than a certain value in a direction opposite to Q6, that is, in a direction of an arrow Q7 (hereinafter, simply referred to as "a Q7 direction"), the convex portion 118A is dented in the direction apart from the rail 151 and moves in the Q7 direction going over the convex portion 155. This releases the suppression of the movement of the sliding base 101 in the Q7 direction so that the sliding base 101 may move in the Q7 direction.

The convex portion 156 of the groove 153 of the rail 151 is disposed at a position touching the convex portion 118A in a state of positioning the sliding base 101 at the limit of movement in the Q7 direction. With that, as the sliding base 101 moves in the Q7 direction, the convex portions 118A and 156 contact with each other before reaching the limit of movement in the Q7 direction. In this case as well, the convex portion 118A is dented in a direction apart from the rail 151 by being pressed by the convex portion 156 and goes over the convex portion 156.

As illustrated in FIG. 17, the rail 151 has a stopper 158 at an open end portion of the groove 153. The stopper 158 is disposed at a position not touching the guide rail 117A. As the sliding base 101 continues moving in the Q7 direction, the convex portion 119A contacts with the stopper 158 and it turns out not being able to move in the Q7 direction more than that. The convex portion 119A contacts with the stopper 158, thereby causing the sliding base 101 to reach the limit of movement in the Q7 direction.

Figure 18:
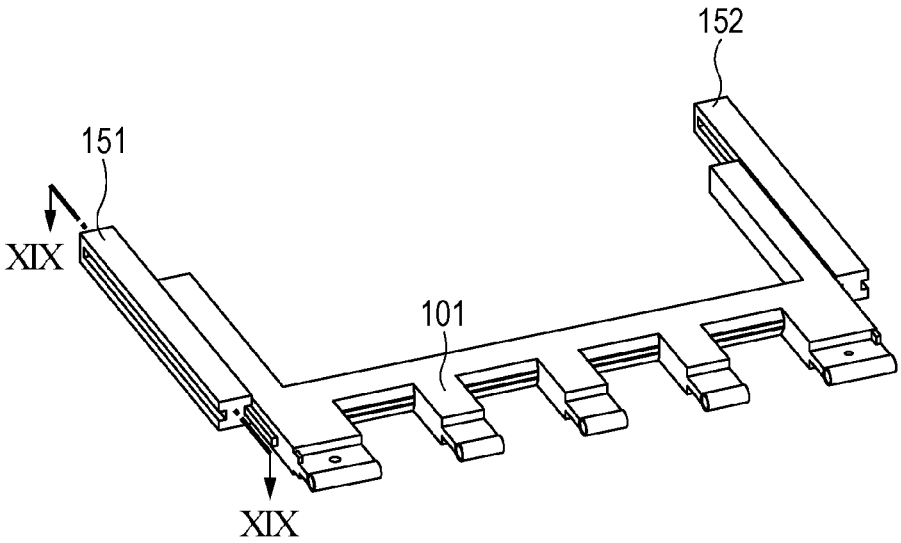
FIG. 18 is a perspective view of a state of the sliding base being positioned at a limit of movement in a forward direction.
Figure 19:
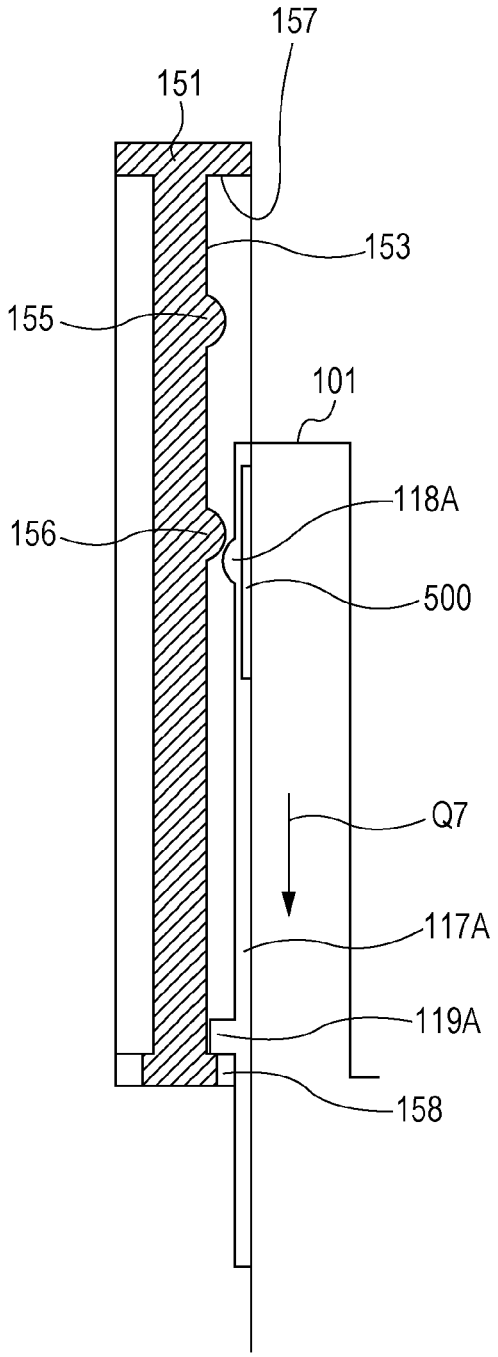
FIG. 19 is a cross-sectional view taken from XIX-XIX in FIG. 18.

FIG. 18 is a perspective view of a state of the sliding base being positioned at a limit of movement in a forward direction. FIG. 19 is a cross-sectional view taken from XIX-XIX in FIG. 18. FIG. 19 also illustrates, for the convenience of illustration, only a portion of fitting the sliding base 101 with the rail 151 in the XIX-XIX cross-section.

FIG. 18 represents a state of sliding the sliding base 101 along the rails 151 and 152 to the limit of movement in the forward direction in FIG. 1 in a state of attaching the lock releasing tool 100 to the switching hub device 1.

As the sliding base 101 moves in the Q7 direction, the convex portion 119A contacts with the stopper 158 to be stopped as illustrated in FIG. 19. This causes the sliding base 101 to be suppressed in the movement in the Q7 direction more than that, and thus it becomes the limit of movement in the forward direction in FIG. 1 in a case of attaching the lock releasing tool 100 to the switching hub device 1. As described above, the convex portion 156 of the groove 153 of the rail 151 is disposed at a position touching the convex portion 118A in a state of positioning the sliding base 101 at the limit of movement in the Q7 direction. Therefore, in a state of positioning the sliding base 101 at the limit of movement in the Q7 direction, the movement of the sliding base 101 in the Q7 direction is suppressed by the stopper 158, and the movement of the sliding base 101 in a direction opposite to Q7 is suppressed by the convex portion 156. This enables the sliding base 101 to maintain the state of being stopped at the position of the limit of movement in the Q7 direction.

Figure 20:
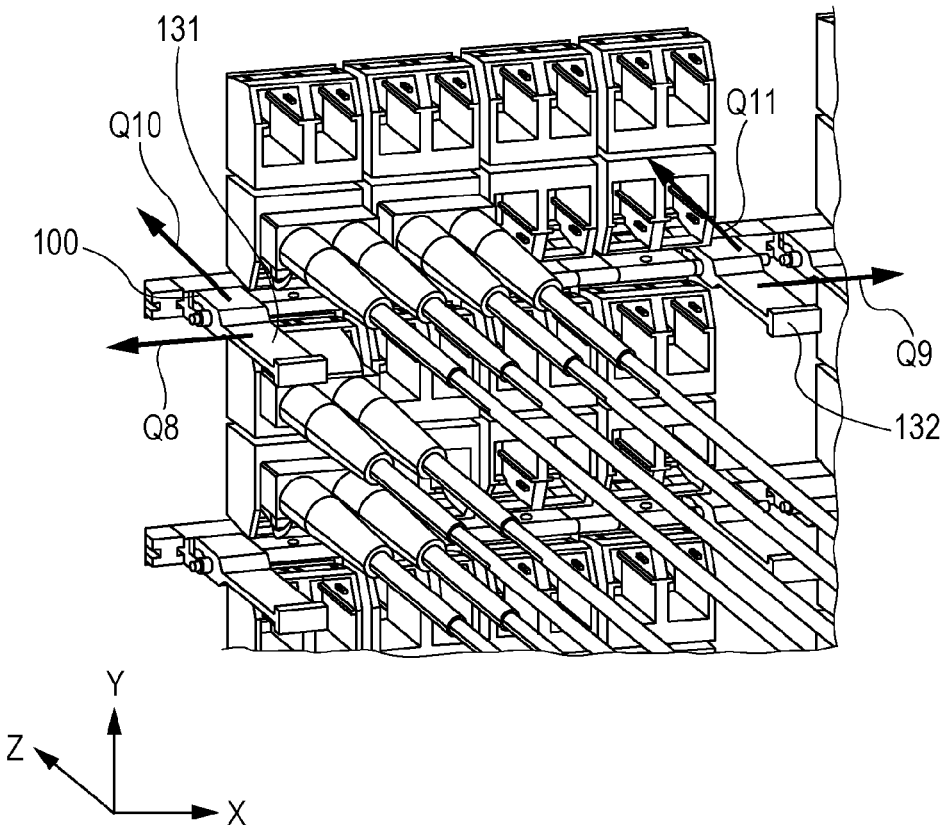
FIG. 20 is a perspective view of the switching hub device before releasing the lock.
Figure 21:
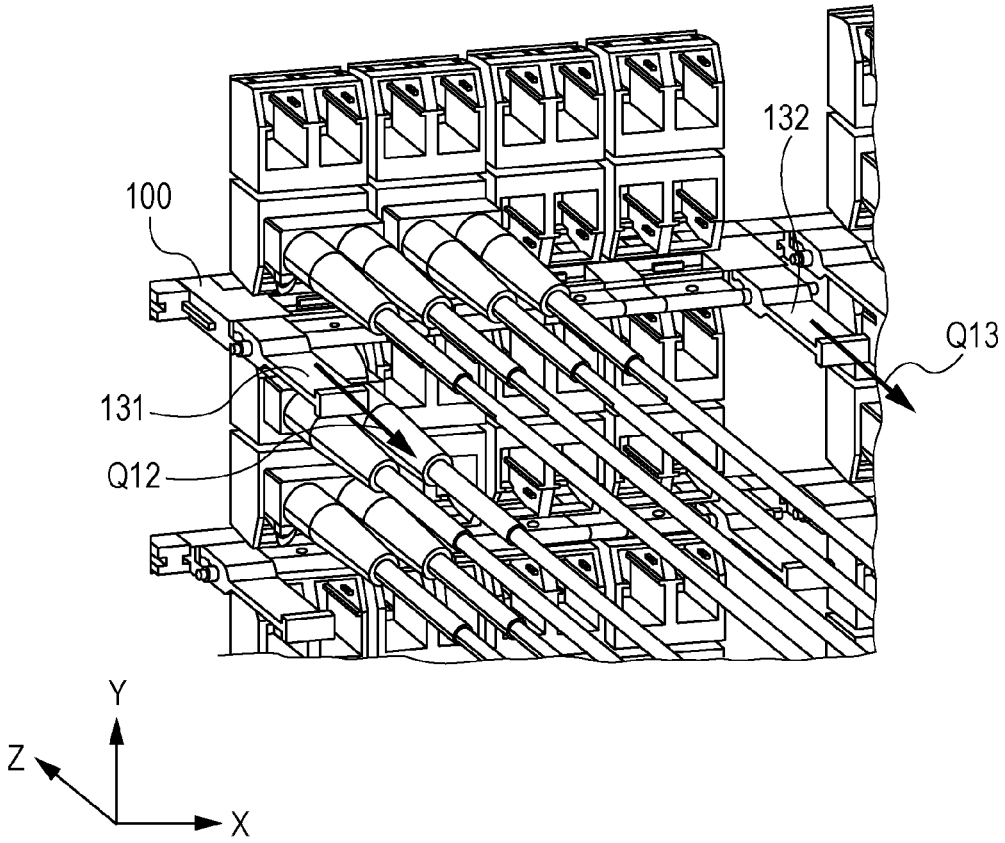
FIG. 21 is a perspective view of a state of the lock releasing tool being drawn out.
Figure 22:
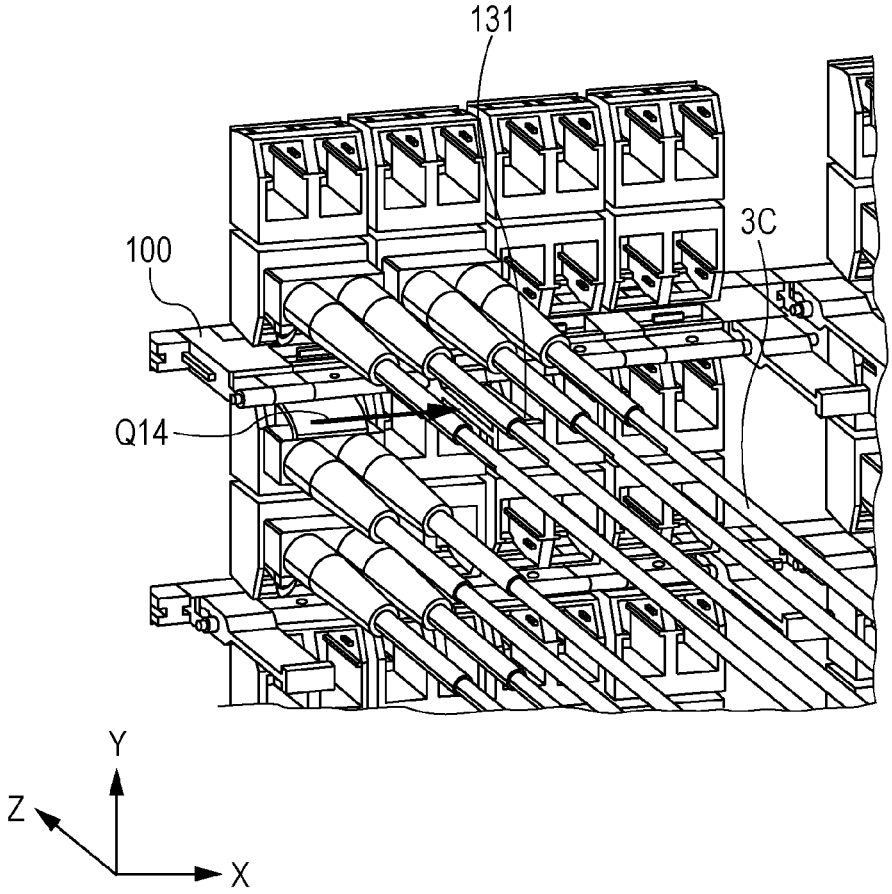
FIG. 22 is a perspective view of a state of moving the handle to a position of an FC cable to be removed.
Figure 23:
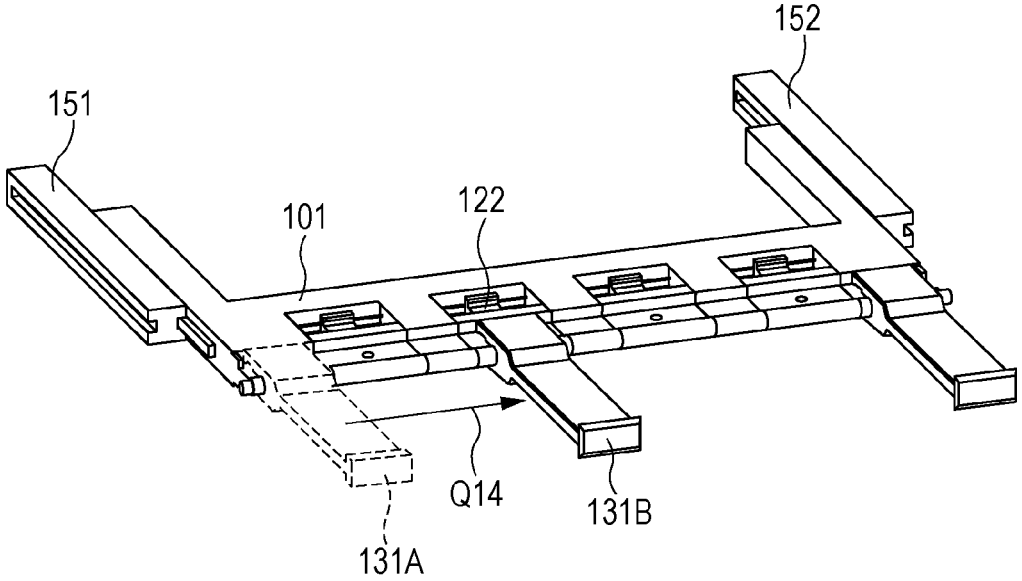
FIG. 23 is a diagram for illustration of the movement of the handle in FIG. 22.
Figure 24:
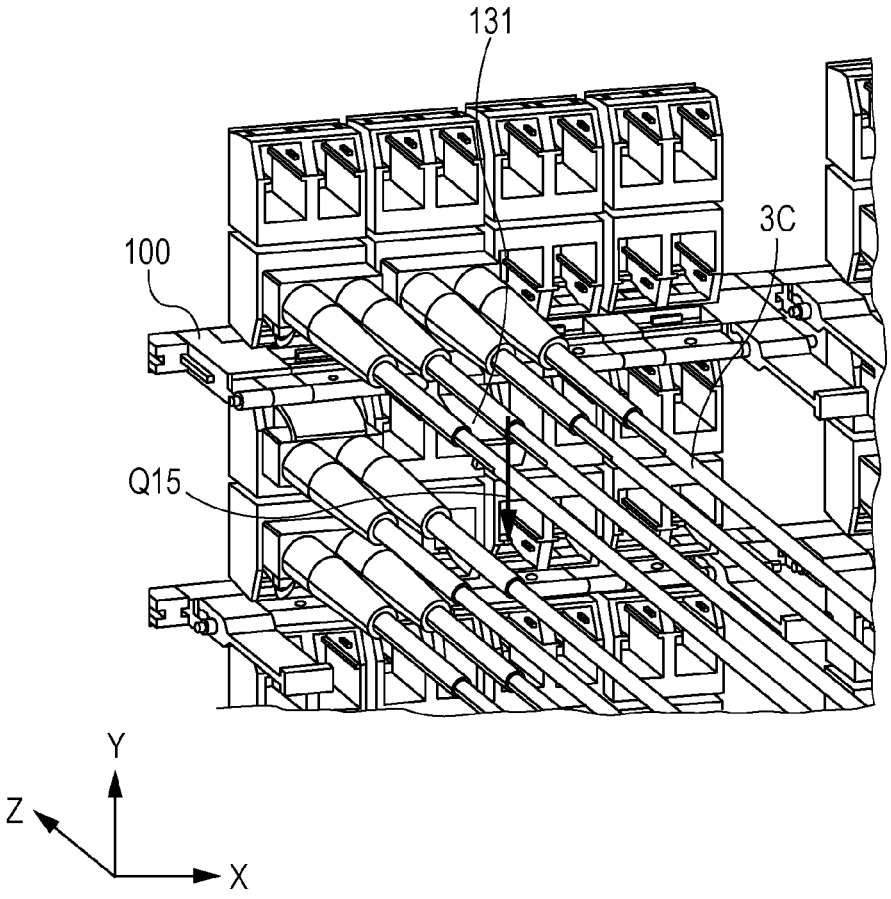
FIG. 24 is a perspective view of a state of releasing the lock by lowering the handle.
Figure 25:
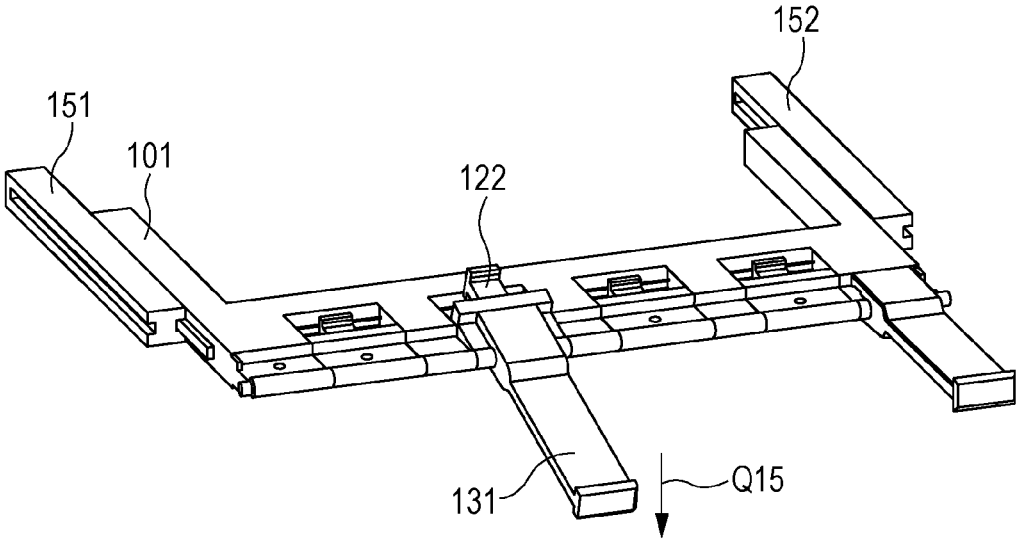
FIG. 25 is a diagram for illustration of the operation of the handle and the behavior of the unlocking lever in FIG. 24.

Next, with reference to FIGS. 20 through 25, a series of behaviors of releasing the lock in the switching hub device 1 is described. FIG. 20 is a perspective view of the switching hub device before releasing the lock. FIG. 21 is a perspective view of a state of the lock releasing tool being drawn out. FIG. 22 is a perspective view of a state of moving the handle to a position of an FC cable to be removed. FIG. 23 is a diagram for illustration of the movement of the handle in FIG. 22. FIG. 24 is a perspective view of a state of releasing the lock by lowering the handle. FIG. 25 is a diagram for illustration of the operation of the handle and the behavior of the unlocking lever in FIG. 24. Here, similar to FIG. 1, the description is given by defining the X direction as the transverse direction, the Y direction as the vertical direction, and the Z direction as the front/rear direction. Hereinafter, an operation by an operator (hereinafter, simply referred to as "an operator") who operates the FC cables connected with the switching hub device 1 is described. In addition, a direction of each arrow is denoted using reference characters given to the arrow. For example, the direction of an arrow Q8 is denoted simply by "a Q8 direction".

As illustrated in FIG. 20, in a case of not carrying out a lock releasing operation, the operator moves the handle 131 in the Q8 direction to migrate it from the position of the unlocking lever. In addition, the operator moves the handle 132 in a Q9 direction to migrate it from the position of the unlocking lever. This causes, in a case of not carrying out the lock releasing operation, the handles 131 and 132 to be disposed in locations apart from the unlocking levers and enables to avoid an operational error of releasing the lock by operating the handle. Then, the operator presses the handles 131 and 132 in Q10 and Q11 directions, which are the backward directions, to push the entire lock releasing tool 100 into the backward direction. This causes the unlocking lever to be disconnected from the position of the lock releasing lever of the FC cable, so that it is possible to secure more to avoid an operational error of releasing the lock. In addition, the lock releasing tool 100 is stored in the back and also the handles 131 and 132 are migrated from the positions of the unlocking levers, thereby enabling not to inhibit the insertion of the FC cable into the connector.

In a case of carrying out the lock releasing operation, as illustrated in FIG. 21, the operator pulls the handles 131 and 132 in Q12 and Q13 directions, which are the forward directions, to draw out the entire lock releasing tool 100 in the forward direction. This causes the unlocking lever of the lock releasing tool 100 to move to the position allowing to press the lock releasing lever of the FC cable.

Next, as illustrated in FIG. 22, the operator slides the handle 131 or 132 to positions of the unlocking levers corresponding to the FC cables intended to be removed. In the present embodiment, a description is given in a case of removing the second FC cable 3C from the right. For example, the operator slides the handle 131 in a Q14 direction and moves it to the position of the second unlocking lever from the right. In this case, as in FIG. 23, the sliding base 101 is drawn out along the rails 151 and 152, and is in a state of positioning at the limit of movement in the forward direction. Then, the handle 131 slides in the Q14 direction, and goes from the state of a handle 131A on to a state of a handle 131B sandwiching the unlocking lever 122.

Next, as illustrated in FIG. 24, the operator revolves the handle 131 in a direction of pressing the lock releasing lever of the FC cable 3C intended to be removed by the unlocking lever. In the present embodiment, the FC cable 3C is on an upper side of the lock releasing tool 100, so that the operator presses down the handle 131 to rotate the unlocking lever upward. In this case, as in FIG. 25, the sliding base 101 is drawn out along the rails 151 and 152, and the unlocking lever 122 is at the position of touching the lock releasing lever of the FC cable 3C by rotating it. Then, the handle 131 revolves in the Q15 direction to rotate the unlocking lever 122. This causes the lock releasing lever of the FC cable 3C to be pressed by the unlocking lever, and thus the fitting of the connector claw of the connector with the locking claw of the FC cable 3C is disconnected, the lock is released, and the FC cable 3C becomes in a state of allowing removal.

Figure 26:
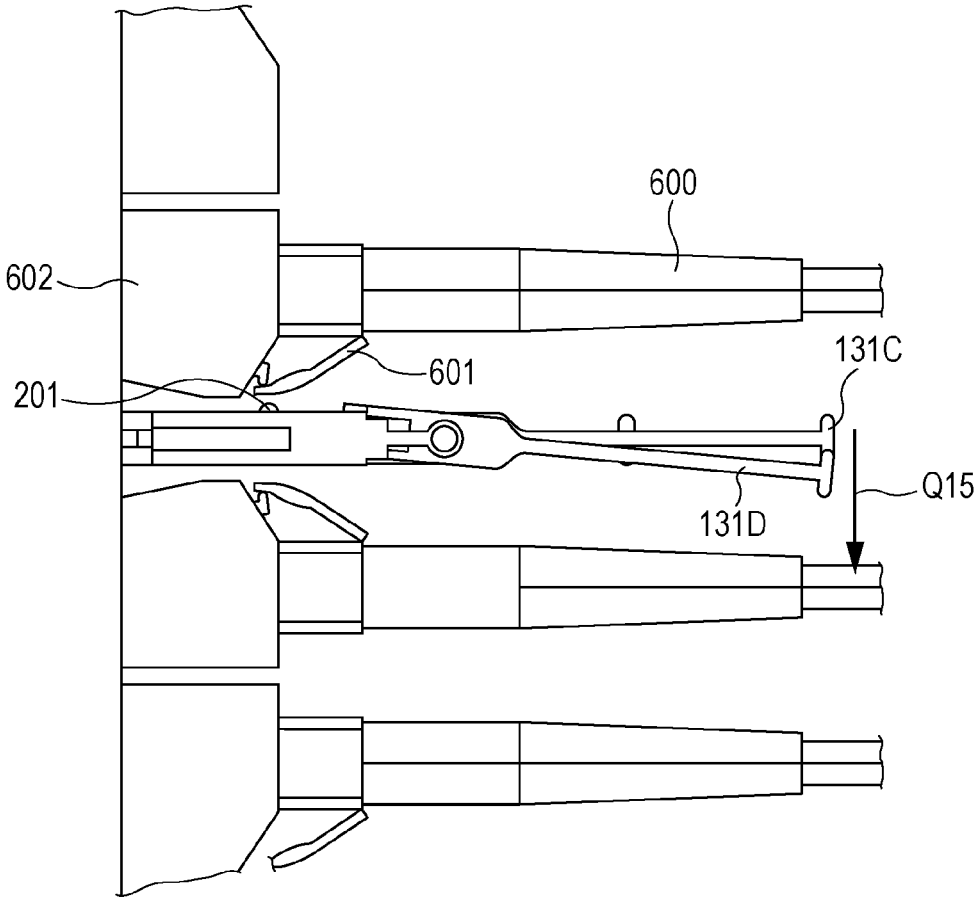
FIG. 26 is a diagram illustrating a state of the handle and the unlocking lever when starting a lock releasing behavior.
Figure 27:
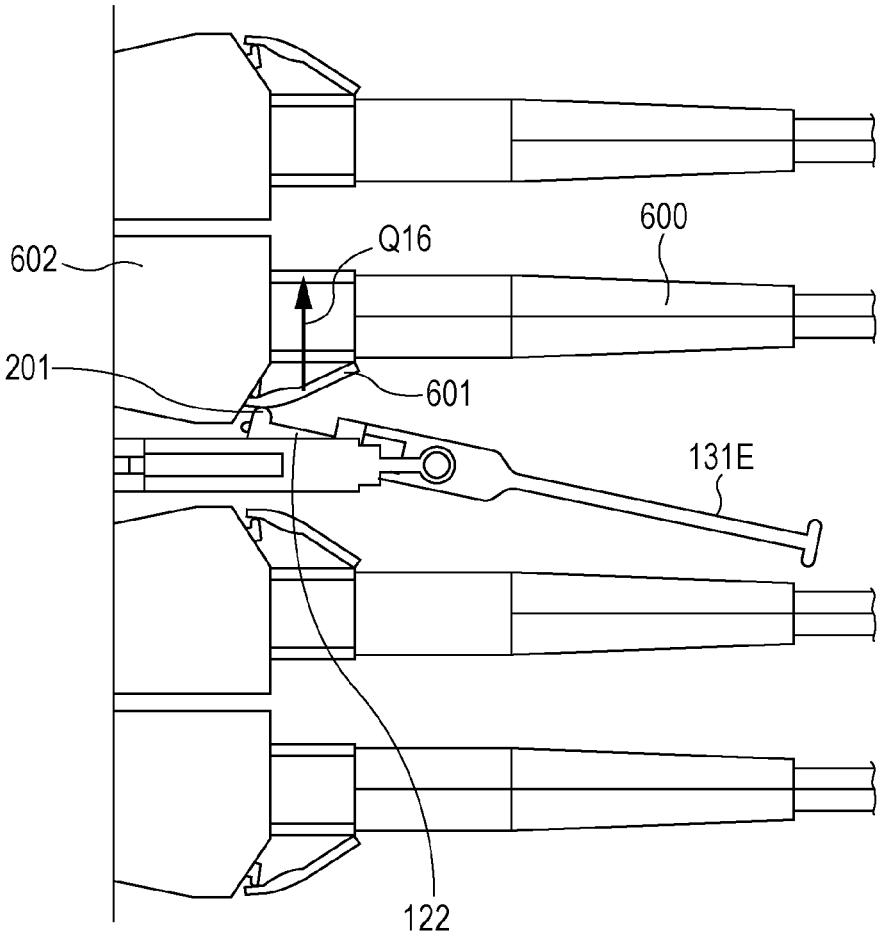
FIG. 27 is a diagram illustrating a state of the unlocking lever making contact with the lock releasing lever.
Figure 28:
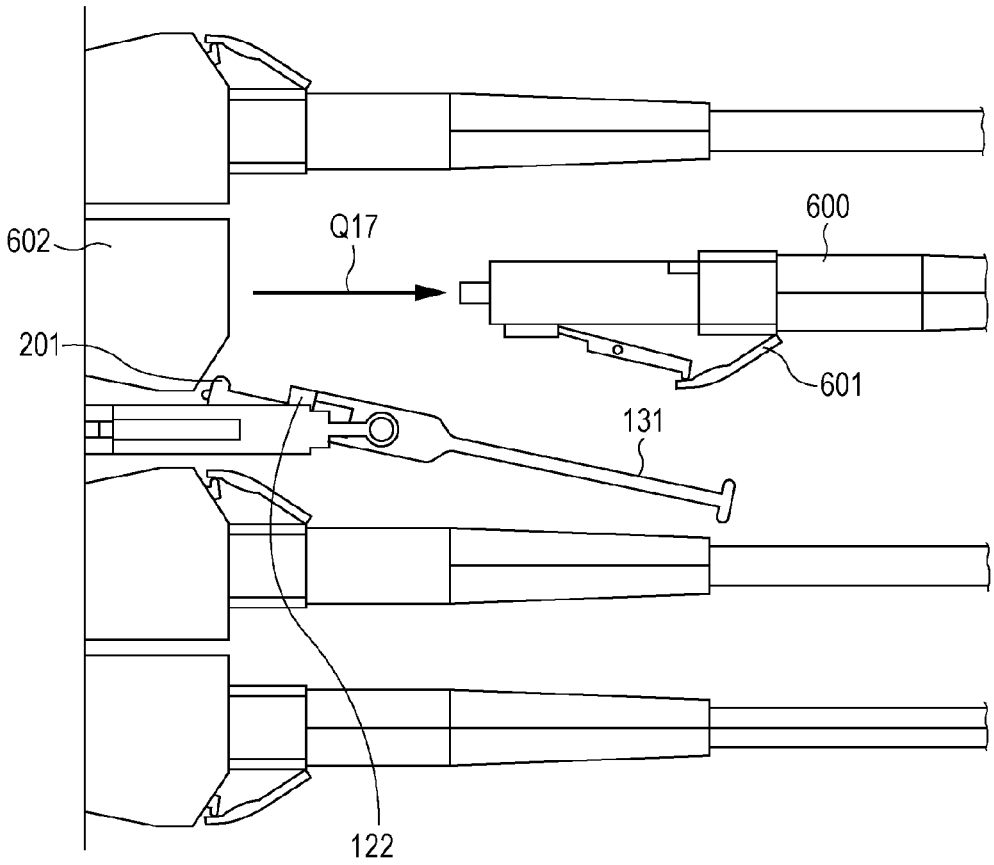
FIG. 28 is a diagram illustrating a state when the FC cable is removed by releasing the lock.

Next, with reference to FIGS. 26 through 28, lock releasing by the unlocking lever is described in detail. FIG. 26 is a diagram illustrating a state of the handle and the unlocking lever when starting a lock releasing behavior. FIG. 27 is a diagram illustrating a state of the unlocking lever making contact with the lock releasing lever. FIG. 28 is a diagram illustrating a state when the FC cable is removed by releasing the lock.

A state of a handle 131C in FIG. 26 is a state of not applying a force to the handle. Then, in order to remove an FC cable 600 from a connector 602, a force in the Q15 direction is applied to the handle to become in a state of a handle 131D. In state of not applying a force to the handle and a state immediate after starting the rotation of the unlocking lever, the projecting portion 201 of the unlocking lever does not contact with a lock releasing lever 601.

From the state of FIG. 26, by further applying a force to the handle, the handle becomes in a state of a handle 131E in FIG. 27. At this time, the projecting portion 201 of the unlocking lever 122 contacts with the lock releasing lever 601 of the FC cable 600. Then, a downward force is further applied to the handle 131E, thereby moving the unlocking levers 122 and the projecting portion 201 thereof in the Q16 direction to press up the lock releasing lever 601 in the Q16 direction. This causes the locking claw provided in the lock releasing lever 601 to be pressed upward, and thus the fitting of the locking claw with the connector claw of the connector 602 is disconnected to release the lock of the FC cable 600 by the connector.

As the lock is released, the FC cable 600 may be removed from the connector 602. With that, as in FIG. 28, in a state of lowering the handle 131 to move the unlocking lever 122 and the projecting portion 201 thereof to a side of the lock releasing lever 601, the FC cable 600 is pulled in the Q17 direction. In such a manner, the operator removes the FC cable 600 from the connector 602.

Figure 29:
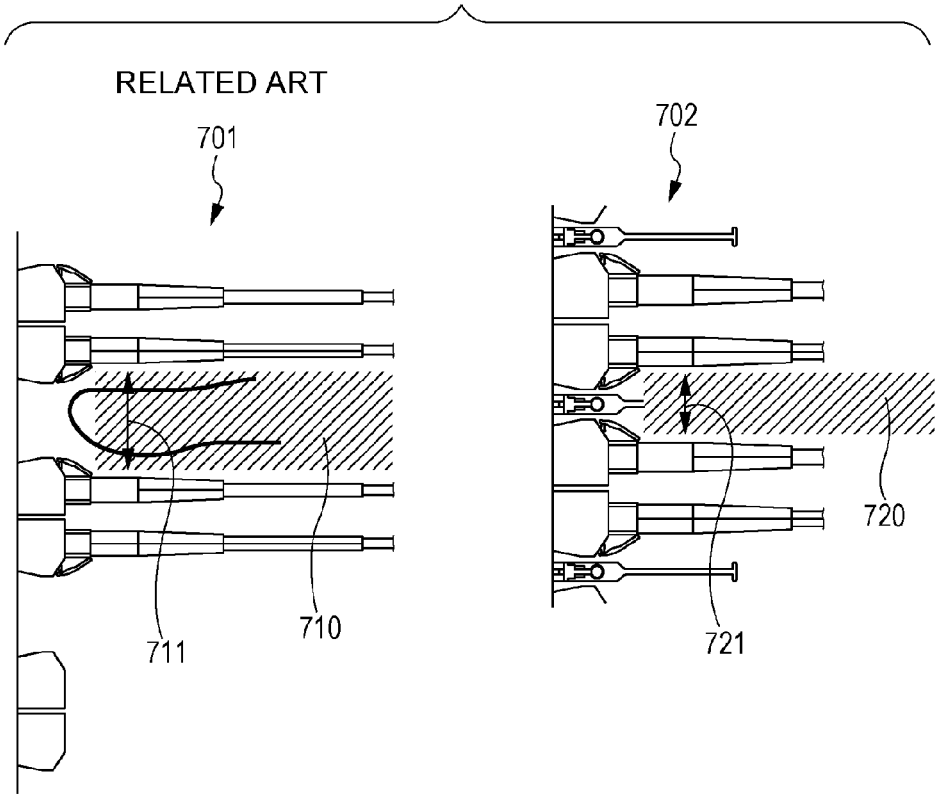
FIG. 29 is a diagram used for comparison of the packaging density of connectors between a conventional switching hub device and a switching hub device according to the present embodiment.

FIG. 29 is a diagram used for comparison of the packaging density of connectors between a conventional switching hub device and a switching hub device according to the present embodiment. A state 701 represents a state of disposing connectors in a switching hub device in the past. A state 702 represents a state of disposing connectors in the switching hub device according to the present embodiment. As illustrated in the state 701, the switching hub device in the past is provided with a space 710 to put a finger between the connectors. In the switching hub device in the past, for example, an interval 711 between the connectors is 15 mm. In contrast, in the switching hub device according to the present embodiment, as in the state 702, the lock releasing tool is disposed and there may further be a space 720 at least to move the handle. In the switching hub device according to the present embodiment, for example, an interval 721 between the connectors may be 5 mm. In such a manner, in the switching hub device according to the present embodiment in comparison with the switching hub device in the past, the space between the connectors may be approximately half or less. Specifically, a width between the connectors may be suppressed approximately 10 mm. Therefore, for example, with a device having a height of 4 U (U is a unit for a height of the device packaged in a rack), in the switching hub device in the past, 176 ports (items) of connectors are disposed. In contrast, in the switching hub device according to the present embodiment, for example, 224 ports (items) of connectors may be disposed, which is 48 ports (items) more than the past. This enables the switching hub device according to the present embodiment to increase the packaging density of the connectors approximately 27% compared with the switching hub device in the past.

In addition, in the above description, from the perspectives, such as avoiding an operational error, the handles 131 and 132 are moved to the sides of the sliding base 101 at the time other than carrying out the release of the lock, while the handles 131 and 132 may also be disposed in another location as long as an operational error may be avoided. For example, the handles 131 and 132 may also be detachable to the unlocking levers 121 through 124. In this case, in a case of not carrying out the lock release, the handles 131 and 132 may also be removed. Further, in a case that the handles 131 and 132 are detachable to the unlocking levers 121 through 124, for example, the sliding groove formed by the sliding base 101 and the unlocking levers 121 through 124 may also not provided.

Further, in the present embodiment, while the description has been given to a state of providing the lock releasing tool 100 to the switching hub device 1 at all times, this may also be another method, and for example, the lock releasing tool 100 may also be detachable to the switching hub device 1. In this case, for example, in a case of removing the FC cable from the connector, the lock releasing tool 100 is attached to the switching hub device 1 to carry out the lock releasing behavior.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

What is claimed is:

1. A switching hub device, comprising:

a connector group including a plurality of connectors, the plurality of connectors each having a hole to insert a cable and including a locking unit to lock the cable inserted into the hole;

a plurality of lock releasing members each to release the cable from the locking unit of each of the connectors by pressing a lock releasing unit provided in the cable;

a supporting member to rotatably support each of the lock releasing members facing the lock releasing unit; and a handle having a fitting portion to fit with each of the lock releasing members supported by the supporting member, the handle gripping each of the lock releasing members fitted with the fitting portion.

2. The switching hub device according to claim 1, wherein the supporting member and each of the lock releasing members have a sliding groove continued to each other, and the fitting portion of the handle fits with the sliding groove.

3. The switching hub device according to claim 1, wherein the lock releasing members each has a positioning portion that positions the handle when the handle is fitted with each of the lock releasing members, and the fitting portion of the handle has an engaging portion that engages with the positioning portion.

4. The switching hub device according to claim 1, further comprising a rail disposed in a direction of inserting and removing the cable, wherein the supporting member slides along the rail, and the lock releasing members each is at a position capable of pressing the lock releasing unit in a state of the supporting member reaching a limit of movement in a direction of removing the cable by sliding along the rail, and the lock releasing members each is at a position of not pressing each of the lock releasing member in a state of the supporting member reaching the limit of movement in a direction inserting the cable by sliding along the rail.

5. The switching hub device according to claim 1, wherein the locking unit locks the cable by being fitted with a locking claw of the cable, and the lock releasing members each presses the lock releasing unit by rotation of the handle to release the fitting of the locking claw with the locking unit.

6. A connector lock releasing tool, comprising:

a plurality of lock releasing members each to release a cable from a locking unit of each of connectors by pressing of a lock releasing unit provided in the cable;

a supporting member to rotatably support each of the lock releasing members facing the lock releasing unit; and a handle having a fitting portion to fit with each of the lock releasing members supported by the supporting member, the handle gripping each of the lock releasing members fitted with the fitting portion.

* * * * *